US007178728B2

(12) United States Patent
Kojima

(10) Patent No.: US 7,178,728 B2
(45) Date of Patent: Feb. 20, 2007

(54) CARD PROCESSING SYSTEM AND CARD PROCESSING METHOD IN TOLL ROAD

(75) Inventor: Hideaki Kojima, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/647,516

(22) Filed: Aug. 26, 2003

(65) Prior Publication Data

US 2004/0046019 A1 Mar. 11, 2004

(30) Foreign Application Priority Data

Sep. 5, 2002 (JP) ..... 2002-260227

(51) Int. Cl.
*G07B 15/02* (2006.01)

(52) U.S. Cl. ..... 235/384; 235/492

(58) Field of Classification Search ..... 235/384, 235/375, 383, 435, 492; 340/928, 933; 705/13, 705/65

See application file for complete search history.

(56) References Cited

U.S. PATENT DOCUMENTS 5,206,495 A * 4/1993 Kreft ..... 235/492
5,310,999 A * 5/1994 Claus et al. ..... 235/384
5,532,689 A * 7/1996 Bueno ..... 340/928
5,926,546 A * 7/1999 Maeda et al. ..... 705/65
5,955,970 A * 9/1999 Ando et al. ..... 340/928
6,019,285 A * 2/2000 Isobe et al. ..... 235/384
6,068,193 A * 5/2000 Kreft ..... 235/492
6,609,655 B1 * 8/2003 Harrell ..... 235/380
6,690,293 B2 * 2/2004 Amita ..... 340/928
2002/0115410 A1 * 8/2002 Higashino et al. ..... 455/41
2002/0183094 A1 * 12/2002 Seita ..... 455/558
2004/0004120 A1 * 1/2004 Kojima ..... 235/384

FOREIGN PATENT DOCUMENTS

JP 8-16848 1/1996
JP 11-185079 7/1999

* cited by examiner

*Primary Examiner*—Steven S. Paik
(74) *Attorney, Agent, or Firm*—Pillsbury Winthrop Shaw Pittman LLP

(57) ABSTRACT

A card processing system using an IC card that is capable of exchanging information through the electrical contact with the on-board unit installed in a vehicle using a toll road and the wireless communication with an antenna unit installed at the roadside of a toll road includes a first processing unit to execute the process through the wireless communication with an on-board unit with an IC card inserted so as to electrically contact the on-board unit and a second processing unit to execute the process through the wireless communication with the IC card when an error is generated in the process by the first processing unit.

18 Claims, 13 Drawing Sheets

CARD PROCESSING SYSTEM AND CARD PROCESSING METHOD IN TOLL ROAD

CROSS-REFERENCE TO RELATED APPLICATION

This application is based upon and claims the benefit of priority from the prior Japanese Application No. 2002-260227, filed on Sep. 5, 2002; the entire contents of which are incorporated herein by reference.

BACKGROUND OF THE INVENTION

1. Field of the Invention

This invention relates to a card processing system and a card processing method for paying, for example a toll of a toll road using a prepaid IC card.

2. Description of Related Art

At present, a magnetic type prepaid card (hereinafter referred to as a magnetic card) available widely in the market can be obtained with ease anonymously and therefore, is highly convenient for users and is used widely as a conventional type toll collection system in a toll road.

Further, an Electronic Toll Collection System (ETC system) has been introduced into toll roads. In this ETC system, an on board unit is installed on a vehicle and when an ETC card is inserted into this on board unit, the on board unit communicates with an antenna installed in a tollbooth and the entrance or exit process is executed. Thus, a vehicle is able to pass through a tollhouse without stopping in most cases.

On the other hand, in recent years, in transportation facilities such as railways, non-contact IC cards equipped with a function to communicate with an automatic ticket examiner in weak wave are in use and contributing to the alleviation of congestion in recent years.

In such circumstances, change from magnetic card to IC cards and furthermore, regarding IC cards, common use of ETC cards and non-contact IC cards is inevitable and there are such problems as described below in this case.

That is, magnetic prepaid cards used in a conventional toll collection system always take a risk of illegal rewriting of monetary information and other data and enhancement of security is strongly demanded.

Further, the ETC system is operated in mix with a conventional toll collection system and adversely affected by the low throughput of the conventional toll collection system, the throughput of ETC vehicles is not increased. Accordingly, the congestion is not relieved sharply and it is hardly said the convenience of users is promoted. Further, if any error is generated in the ETC processing, the further drop of throughput results and the users' convenience may possibly become further worse.

Further, because it is possible to use a non-contact IC card using weak radio wave as a simple card, differing from a set contract with an on board unit like ETC, vehicles entered into a toll road may possibly make an illegal deed to exchange IC cards each other.

SUMMARY OF THE INVENTION

An object of this invention is to provide a card processing system and a card processing method that are capable of improving users' convenience while preventing illegal deeds when using an IC card that is provided with an interface function with an on-board unit and a wireless communication function by a single sheet of card in a toll road.

According to this invention, a card processing system using an IC card capable of exchanging information through an electric contact with an on-board unit installed in a vehicle using a toll road and a wireless communication with an antenna unit installed at a roadside of the toll road is provided. This system comprises a first processor configured to execute the process through the wireless communication with the on-board unit by inserting the IC card so as to electrical contact the on-board unit; and a second processor configured to execute the process through the wireless communication with the IC card when an error is generated in the process by the first processor.

Further, according to this invention, a card processing method using an IC card capable of exchanging information through an electrical contact with an on-board unit installed in a vehicle using a toll road and through a wireless communication with an antenna unit installed at a roadside of the toll road is provided. This method comprises first executing a process through the wireless communication with the on-board unit into which the IC card inserted to electrically contact it; and second executing a process through the wireless communication with the IC card when an error is generated during the process of the first executing.

DETAILED DESCRIPTION OF A PREFERRED EMBODIMENT OF THE INVENTION

Preferred embodiments of this invention will be described below in detail referring to attached drawings.

Figure 1:
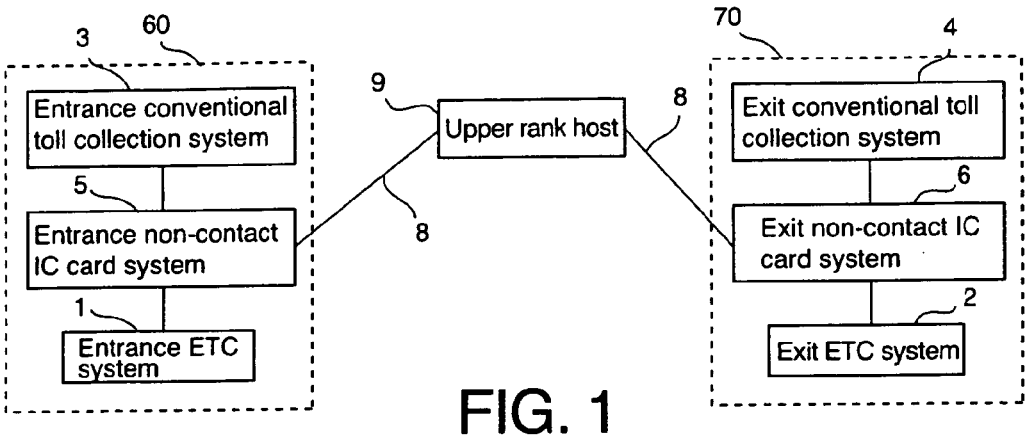
FIG. 1 is a block diagram showing the construction of a toll collection system to which a card processing system in toll roads of this invention is applicable.

A toll collection system to which a card processing system and a card process method in a toll road of this invention are applicable comprises an entrance system 60 that is arranged at the entrance of a toll road, an exit system 70 that is arranged at the exit and a host computer 9 (hereinafter, called as an upper rank host) that is connected to the entrance system 60 and the exit system 70 through a communication line 8 as shown in FIG. 1. The entrance system 60 comprises an entrance ETC system 1, an entrance conventional type toll collection system 3, and an entrance non-contact IC card system 5. The exit system 70 comprises an exit ETC system 2, and exit conventional type toll collection system 4, and an exit non-contact IC card system 6. The conventional type toll collection system referred to here is a system to collect a toll in cash based on information recorded on a issued passing ticket or a system to collect a toll from a magnetic card type prepaid card based on information recorded on a issued passing ticket.

The entrance conventional type toll collection system 3 is a system to perform the discrimination of an automatic vehicle class, passing ticket issue, opening/closing of a gate bar installed in the entrance line. The entrance non-contact IC card system 5 is a system to perform the entrance process through the wireless communication (the non-contact IC card process) with an IC card by weak radio wave. The exit conventional type toll collection system 4 is a system to perform the exit processing for collecting a toll in cash or from a magnetic card type prepaid card based on the information recorded on a passing ticket received by an official in charge from a vehicle driver. The exit non-contact IC card system 6 is a system to perform the exit process (a toll collection process) through the wireless communication with an IC card by weak radio wave (the non-contact IC card processing). The upper rank host 9 receives results of the exit process performed in the inside and at the outside of the traffic lane at the exit of a toll road and IC card processed entrance information at the entrance from the communication line 8 and collates both information. The upper rank host has a function to register an IC card on which a difference is recognized in the collation as an illegal card in the information of the database in the roadside system and distribute this information to the entrance or the exit of a toll road. In addition, the illegal card information may be distributed to the entrance and the exit of a toll road. Further, the upper rank host searches a database in response to an inquiry for collation of information of IC card received from a card processor 30 (see FIG. 6) installed in a tollhouse. And when the card information registered as a usable IC card in the database is matched with the IC card information, the upper rank host 9 replies so to the card processor 30.

Figure 2:
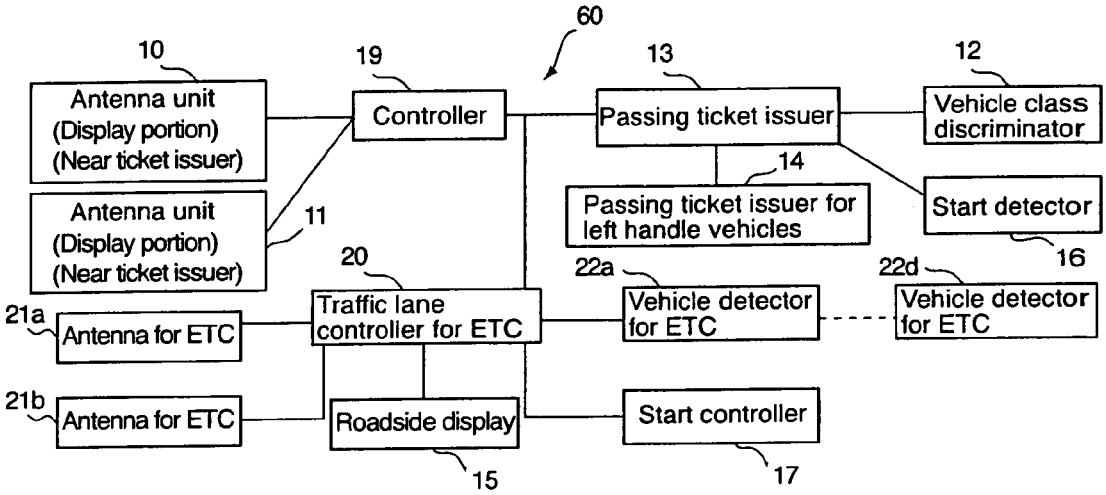
FIG. 2 is a block diagram showing the construction of an entrance ETC system of the toll collection system shown in FIG. 1.
Figure 3:
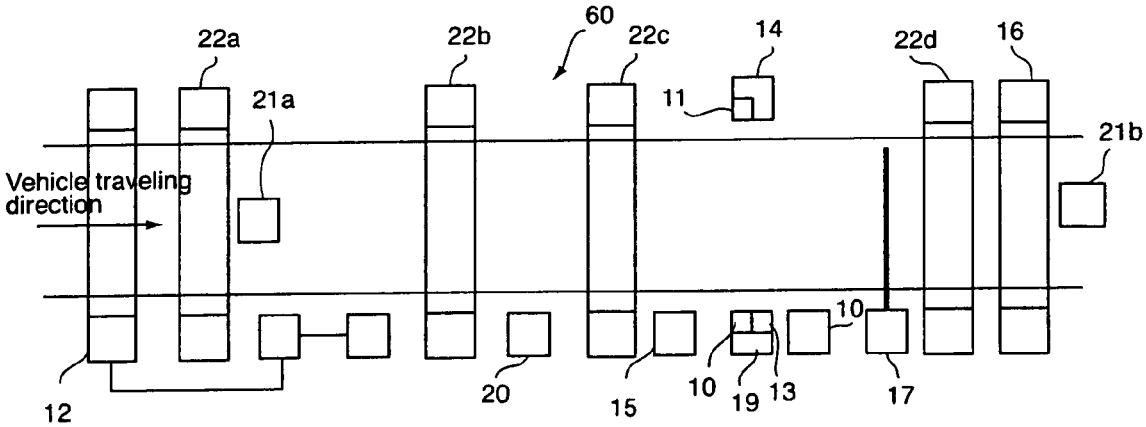
FIG. 3 is a schematic diagram showing the layout of equipment of the entrance system shown in FIG. 2.

The entrance system 60 is composed of antenna units 10 and 11, a vehicle class discriminator 12, a passing ticket issuer 13, an automatic passing ticket issuer for left handle vehicles 14 (hereinafter called as a passing ticket issuer for left handle vehicles 14), a roadside display 15, a start detector 16, a start controller 17, a controller 19, antennas for ETC 21*a* and 21*b*, a traffic lane controller for ETC 20, and vehicle detectors 22*a*~22*d* as shown in FIG. 2 and FIG. 3.

Figure 4A:
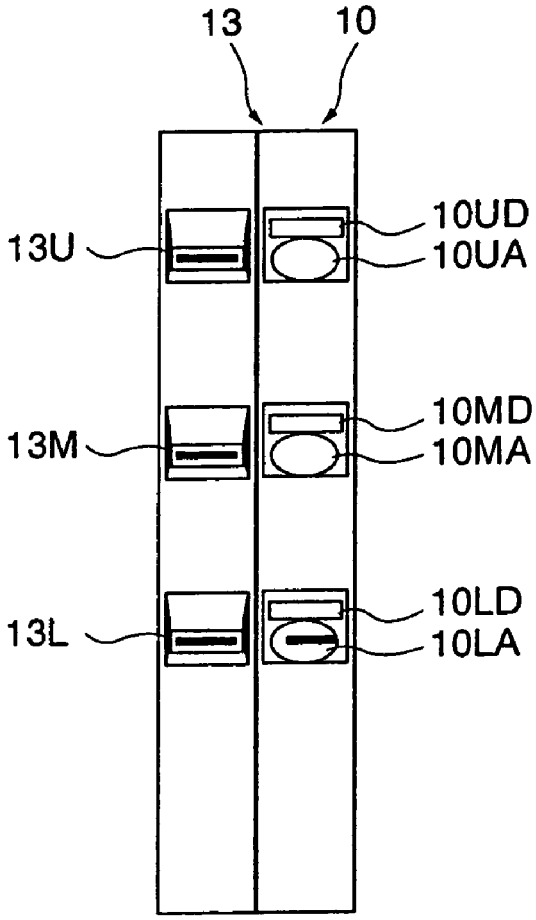
FIG. 4A is a front view of an antenna unit arranged at the right side of the toll road in the entrance system shown in FIG. 3.

The antenna unit 10 has a bar shaped main body installed in the erected state at the right roadside of the traffic lane. The main body is arranged at the position (at the right side in the vehicle traveling direction) of the roadside so that a vehicle driver who once stopped a vehicle entering into the traffic lane is able to reach it by extending the arm through the window. In this main body, the antenna portions 10UA, 10MA and 10LA and displays are arranged at the upper, middle and lower stages, respectively as shown in FIG. 4A. The antenna portion 10UA and an display portion 10UD on the upper stage are for vehicles of which seats are relatively high such as large vehicles, buses, etc. The antenna portion 10MA and a display portion 10MD on the middle stage are for vehicles in medium level height such as residential vehicles, etc. The antenna portion 10LA and a display portion 10LD on the lower stage are for vehicles having relatively lower seats such as passenger cars, light vehicles, bikes, etc. The display portions 10UD, 10MD and 10LD light, blink or display messages when the card processing function (the wireless communication function) of the antenna portions 10UA, 10MA and 10LA selected by the controller 19 are efficient. Messages are such that, for example, "Please hold up your IC card over this position", "Please wait a little until a preceding vehicle is finished", etc.

In the antenna unit 10, when an IC card that is capable of wireless communication is brought close in a prescribed range of at least one of the antenna portions 10UA, 10MA and 10LA, the applicable antenna portion obtains card information from the IC card through the wireless communication. When the acquired card information is normal, vehicle information, vehicle class information, entrance information, etc. are recorded on the IC card through the wireless communication. The prescribed range referred to here is, for example, a range within several 10 cm in this case. Further, such actions as, for example, touch or hold up are included in "bring close".

The antenna unit 11 has a bar shaped main body that is installed in the erected state at the left roadside of the traffic lane. The main body 11 is provided with the antenna portion 11A and the display portion 11D at the almost same height as the antenna portion 10LA at the lower stage of the antenna unit 10. The antenna portion 11A and the display portion 11D are arranged at the position to which a left handle vehicle driver is cable to reach by extending the hand through the window. The display portion 11D lights, blinks or displays messages when the card processing function (the wireless communicating function) of the antenna portion 11A is effective.

That is, the antenna unit 11 is arranged at the roadside (the left side in the vehicle traveling direction) almost opposite to the antenna unit 10 via the traffic lane. The antenna unit 11 obtains card information through the wireless communication with an IC card that is brought close to the position of at least one antenna portion 11A for left handle vehicles and when the card information acquired from the IC card is normal, records vehicle information, vehicle class information and entrance information on the IC card through the wireless communication.

The vehicle class discriminator 12 detects a vehicle entering into the traffic lane and obtains such information of the entered vehicle such as number of axles, height, length, Number Plate, etc. The vehicle class discriminator 12 discriminates a vehicle class from the acquired vehicle information. The vehicle class referred to here is a vehicle classified by an operation side of a toll road in order for toll collection and are, for example, large special, middle, small, light vehicle, etc.

The passing ticket issuer 13 issues a passing ticket according to a class of an entered vehicle when the entrance process was not normally completed for errors generated in the entrance process for an IC card.

The passing ticket issuer for left handle vehicles 14 is arranged at a roadside position that is almost opposite to the passing ticket issuer 13 through the traffic lane and issues a passing ticket to a left handle vehicle driver.

The roadside display 15 displays the processing state and contents of vehicle leading and notifies a vehicle driver of contents of vehicle leading.

The start detector 16 detects a vehicle starting and leaving the traffic lane after a vehicle driver received a passing ticket or the entrance process with an IC card was finished.

The start controller 17 is to approve or block a vehicle to pass according to the entrance process result.

The controller 19 is connected to all devices including the antenna units 10 and 11 through a communication line. The controller 19 obtains information from various units and performs the control of units for the entrance process and roadside units using the antenna units 10 and 11 (the control for making the card processing functions of the antenna units 10 and 11 valid/invalid, the control of passing ticket issue for the passing ticket issuer 13 and the passing ticker issuer for left handle vehicles, the control of opening/closing of the start controller 17, etc.).

Further, the entrance system 60 and the exit system 70 are examples of the construction of a toll collection system according to toll road distances. In a uniform toll collection system, the toll collection process is executed to collect a toll at either the entrance or exit of a toll road. Therefore, the equipment construction similar to the exit system 70 is introduced into the entrance system 60. The uniform toll system is a system to collect a uniform toll in a lump at either the entrance or the exit of a toll road.

The passing ticket issuer 13 is provided with plural ticket issuing units in the vertical direction (at different heights). The passing ticket issuers 13 are arranged side by side with the antenna units 10 as shown in FIG. 4A and the ticket issuing units 13U, 13M and 13L are arranged at the upper, middle and lower stages in the main body, respectively. The ticket issuing unit 13U at the upper stage is for vehicles having relatively higher seats such as large vehicles, buses, etc. The ticket issuing unit 13M at the middle stage is for vehicles in middle height such as residential vehicles, etc. The ticket issuing unit 13L at the lower stage is for vehicles having relatively lower seats such passenger car, light vehicle, bike, etc. These plural ticket issuing units 13U, 13M and 13L of the passing ticket issuer 13 are called as a first passing ticket issuing unit. The ticket issuing units 13U, 13M and 13L have the functions to issue passing tickets under the control of the controller 19, evacuate issued passing tickets temporarily as the case may be and thereafter, fully recover or reissue passing tickets. "As the case may be" are such cases when an IC card was held up over either one of the antenna portions 10UA, 10MA or 10LA or when the processing of an IC card held up over the antenna portions 10UA, 10MA and 10LA was not properly completed.

Figure 4B:
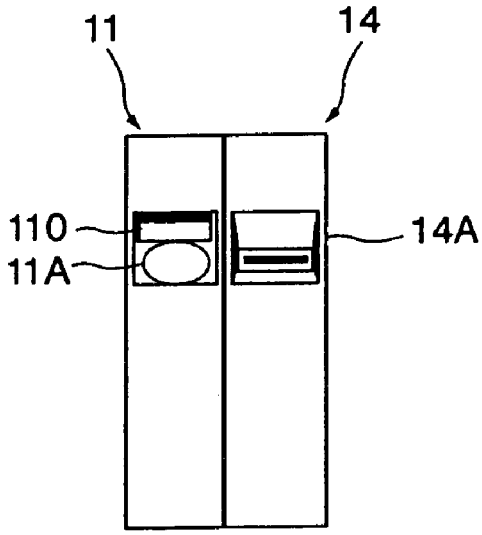
FIG. 4B is a front view of an antenna unit arranged at the left side of the toll road in the entrance system shown in FIG. 3.

The passing ticket issuer for left handle vehicles 14 is arranged side by side with the antenna unit 11 and the ticket issuing unit 14A is arranged at the height nearly same as the ticket issuing unit 13L provided on the lower stage of the passing ticket issuer 13 in the main body as shown in FIG. 4B. The ticket issuing unit 14A is arranged at a position to which a left handle vehicle driver is able to reach by extending the hand from the window. The ticket issuing unit of the passing ticket issuer for left handle vehicles is called as a second passing ticket issuer. The ticket issuing unit 14A has functions to issue passing tickets under the control of the controller 19 and evacuate the issued passing ticket temporarily as the case may be and thereafter, fully recover the issued passing tickets or reissue passing tickets.

That is, the ticket issuing units 13U, 13M and 13L of the passing ticket issuer 13 are corresponding to the antenna portions 10UA, 10MA and 10LA of the antenna unit 10, respectively and are arranged at the closed positions, and the ticket issuing unit 14A of the passing ticket issuer for left handle vehicles are corresponding to the antenna portion 11A of the antenna unit 11 and arranged at the closed positions.

The correspondence of the respective ticket issuing units and the antenna unit is controlled on the address control table in the case of communication of LAN, etc. In addition, the correspondence may be controlled with the physical wiring by dividing the communication line system.

An antenna for ETC 21*a* obtains information of an on board unit and a card that is set in the on board unit through the wireless communication with the on board unit installed on a vehicle. When the obtained IC card information is proper, the antenna for ETC 21*a* transmits entrance information to the on board unit and writes the information on the on board unit and the IC card.

A vehicle detector for ETC 22*a* is arranged near the vehicle class discriminator striding the traffic lane, detects a vehicle entering into the traffic lane and notifies it to a traffic lane controller for ETC 20.

When the vehicle detector 22*a* detects a vehicle entering into the traffic lane, the traffic lane controller for ETC 20 directs an antenna for ETC 21*a* to transmit radio wave and thus, the communication between the antenna for ETC 21*a* and the on-board unit starts. A vehicle detector for ETC 22*b* is arranged at the end position of the communication area of the antenna for ETC 21*a* striding the traffic lane and detecting a vehicle leaving from the communication area of the antenna 21*a* for ETC, notifies it to the traffic lane controller for ETC. When the vehicle detector detects a vehicle leaving from the communication area of the antenna for ETC 21*a* for ETC, the traffic lane controller for ETC 20 directs the antenna for ETC 21*a* to stop the radio wave transmission and the wireless communication by the antenna for ETC 21*a* is terminated. The traffic lane controller for ETC 20 controls the entrance process of ETC roadside equipment. A vehicle detector for ETC 22*c* is arranged at the almost center of the entrance traffic lane striding the traffic lane and detecting a vehicle passing this position, notifies it to the traffic lane controller for ETC 20. A vehicle detector for ETC 22*d* is arranged at the vehicle exit (the end portion) of the entrance traffic lane striding the traffic lane and detecting a vehicle passing this position, notifies it to the traffic lane controller for ETC 20.

Figure 5:
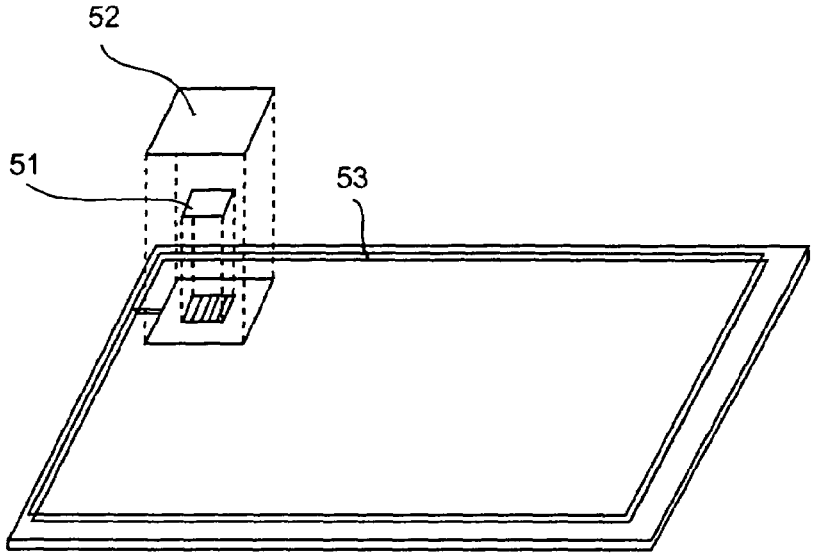
FIG. 5 is a schematic perspective view showing the construction of an IC card that is used in the card processing system and the card processing method of this invention.

An IC card that is used in this toll collection system is composed of an IC chip 51 comprising a semiconductor memory and an operating portion built in the card, a contact-type IC terminal 52 provided on the card surface and an antenna for non-contact type IC 53 formed on the peripheral part of the card as shown in FIG. 5.

In the semiconductor memory of the IC chip 51, individual card information (fixed information) such as card ID No., etc. and variable information including a prepaid amount (a balance amount) and using history information, etc. are stored. In the using history information, vehicle information such as number plate of vehicle specified in the entrance process, etc., discriminated vehicle class information, entrance information, etc. are included. Further, in the semiconductor memory, software to operate the operating portion is stored. This software us read in the operating portion and when an IC card is set in an on-board unit, compares and collates fixed information of the said on-board unit with fixed information of the on-board unit recorded in the IC card. When the conformity is verified as a result of this collation, the entrance information is transcribed (copied) onto the memory of the on-board unit from the IC card memory to match the contents stored in the on-board unit memory and the IC card memory. On the IC card surface, an individual Card ID No. for each card is printed so that the IC card can be visually specified.

The contact type IC terminal 52 is for making the communication with this IC card when it is set in an on-board unit for ETC.

The antenna for non-contact type IC 53 is for making the wireless communication with the antenna portions 10UA, 10MA, 10LA and 11A of the antenna units 10 and 11, and receives radio wave transmitted from the antenna portions 10UA, 10MA, 10LA and 11A of the antenna units 10 and 11.

That is, this IC card is equipped with an IC chip called as a wireless tag that is provided on the inner substrate, a contact type IC terminal serving as an interface (an electric contact) with the card processor 30, and an antenna (the antenna for non-contact type IC 53) formed by the patterning of conductors to the substrate (the copper foil printed wiring, etc.).

Figure 6:
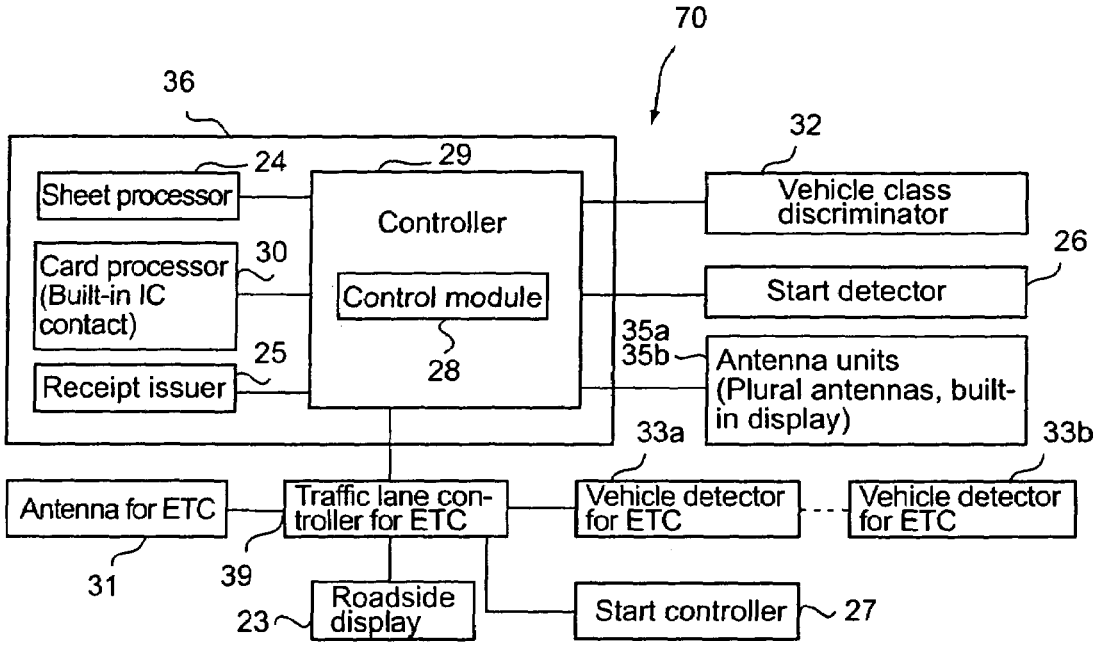
FIG. 6 is a block diagram showing the construction of an exit system of the toll collection system shown in FIG. 1.
Figure 7:
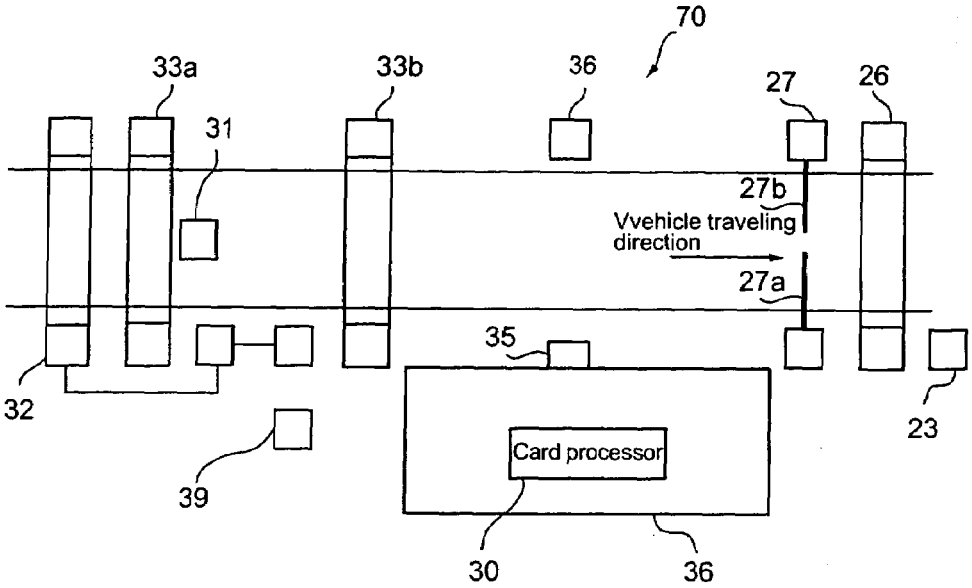
FIG. 7 is a schematic diagram showing the layout of equipment of the exit system shown in FIG. 6.

The exit system 70 is composed of antenna units 35 and 36, the vehicle class discriminator 32, a roadside display 23 a sheet processor 24, a receipt issuer 25, the start detector 26, the start controller 27, the card processor, the controller 29, an antenna for ETC 31, vehicle detectors 33*a* and 33*b* for ETC and a traffic lane controller for ETC 39 as shown in FIG. 6 and FIG. 7. Further, the sheet processor 24, the receipt issuer 25, the controller 29 and the card processor 30 are arranged in an official in charge booth 36 provided at the roadside.

The roadside display 23 displays the IC card processing status (a subtracted amount, a balance after the subtraction, etc.) and urging the process by IC card.

The sheet processor 24 processes passing tickets, etc. and makes the display for clerk in charge. An official in charger executes the input operation.

The receipt issuer 25 issues certificates for toll road usage.

The card processor 30 executes the read/write of contact type IC cards for ETC.

The controller 29 executes the process relative to toll collection by obtaining IC card information through the card processor 30 and has a built-in control module 28 that controls roadside equipment.

The vehicle class discriminator 32 detects a vehicle passing a toll road and entering into the exit traffic lane (the exit lane)(a vehicle leaving the toll road) and obtains information of that vehicle such as number of axles, height, length, number plate, etc. of the vehicle. The vehicle class is discriminated from this obtained vehicle information. Vehicle classes referred here are, for example, large, large special, middle, small, light vehicles.

The card processor 30 is equipped with an interface (a contact type IC terminal) with the contact type IC terminal for IC card. When an IC card is inserted and both terminals are connected, the communication is started and a toll collection process is executed based on the information stored in the IC card.

Further, the card processor 30 is provided with a function to make the wireless communication similar to the antenna units 10 and 11; that is, the function is to read information from an IC card through the wireless communication with the IC card when an IC card is held up over or touched the surface of the card processor and write the processing result. This wireless communication function is to execute read/write process of information to/from the IC chip 51 of an IC card and checking process of written information by transmitting radio wave in the communication range of, for example, about several ten cm and through the resonance of the transmitted radio wave with the antenna for non-contact type IC.

The control module 28 of the controller 29 is a part of a semiconductor memory and stores a control program for control of processes relative to IC cards and vehicles and equipment in the an official in charge booth 36 or the roadside equipment. Further, the control module 28 themselves may be used as a software. The controller 29 executes the process of the control module 28, the process relative to a toll road (the exit process, etc.) and the control of above-mentioned equipment. In the control module 28, the exit information (Tollhouse No., Lane No., fares of own tollhouse and other tollhouses (a fare table), etc.) are stored. The control module 28 (or the sheet processor 24, etc.) computes a passing fare (using fare) from the entrance information and exit information stored (recorded) on an IC card of a vehicle leaving from a toll road and collects it.

The antenna 31 for ETC obtains information of an on-board unit and an IC card that is set in the on-board unit through the wireless communication with the on-board unit installed in a vehicle. Further, the antenna for ETC 31 sends data of toll collection processed result by ETC to an on-board unit and stores it in the on-board unit and an IC card. The vehicle detector for ETC 33*a* is arranged neat the vehicle class discriminator 32 striding the traffic lane and detecting a vehicle entering into the traffic lane, notifies it to the traffic lane controller for ETC 39. When the vehicle detector for ETC detects an entering vehicle, the traffic lane controller for ETC 39 directs the transmission of radio wave through the antenna for ETC 31 and the communication between the antenna for ETC 31 and an on-board unit is started. The vehicle detector for ETC 33*b* is arranged at the end position of the communication area of the antenna for ETC 31 striding the traffic lane and when detecting a vehicle leaving from the communication area of the antenna for ETC 31, notifies the traffic lane controller for ETC 39. When the vehicle detector for ETC 33*b* detects a vehicle leaving from the communication area of the antenna for ETC 31, the traffic lane controller for ETC 39 gives a direction not to transmit radio wave through the antenna for ETC 31 and the wireless communication for the ETC process by the antenna for ETC 31 is terminated.

Figure 8:
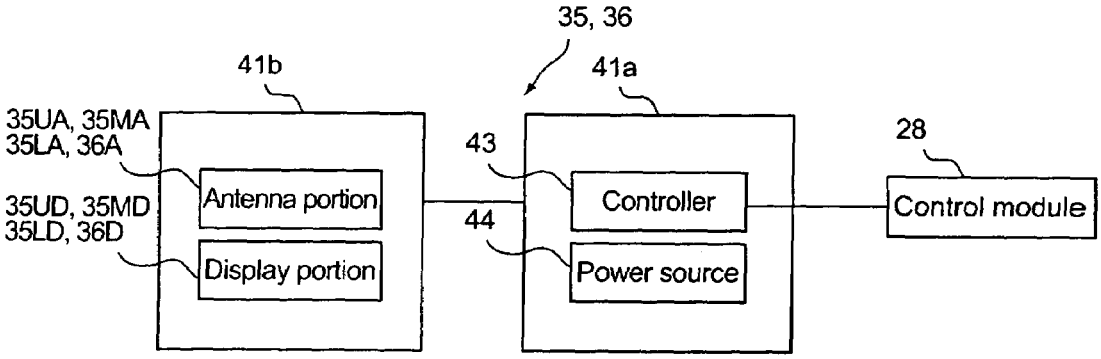
FIG. 8 is a block diagram showing the construction of an outside antenna unit of the exit system.

Antenna units 35 and 36 installed outside a toll booth 36 are composed of an main body with an inside main body 41*a* and an outside main body 41*b* connected with communication lines, a controller 43, a power source 44, the antenna portions 35UA, 35MA, 35LA and 36A, display portions 35UD, 35MD, 35LD and 36D as shown in FIG. 8. The inside main body 41*a* is arranged in the controller 29 and houses the controller 43 and the power source 44. The controller 43 is connected (interfaced with) to the control module 28 of the controller 29. The controller 43 totally controls the entirety of this system and executes the card process of IC cards that are subjects for process by communicating with the control module 28. The power source 44 supplies power to each unit of the system. In the outside main body 41*b*, the antenna portions 35UA, 3MA, 35LA and 36A, the display portions 35UD, 35MD, 35LD and 36D are housed. The antenna portions 35UA, 35MA, 35LA and 36A perform the wireless communication with IC cards. The display portions 35UD, 35MD, 35LD and 36D display matters relative to use of IC card, process state, error contents, etc.

Figure 9A:
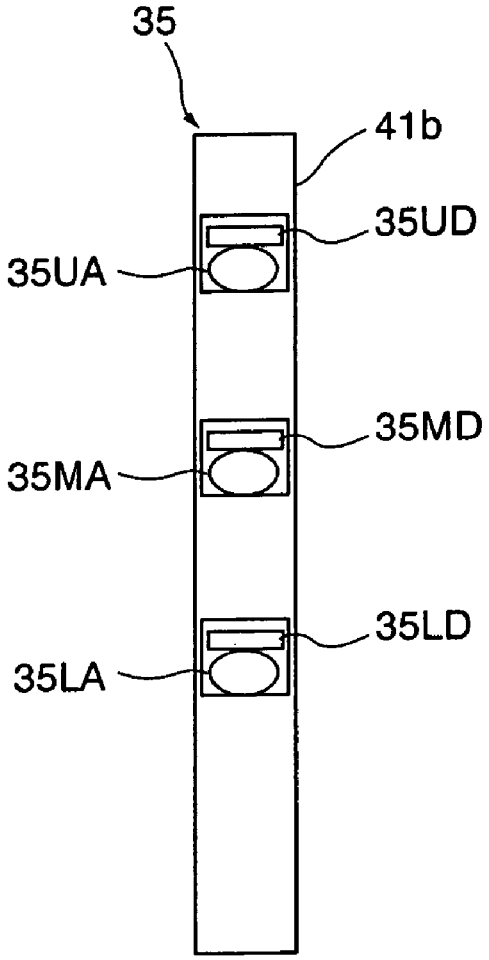
FIG. 9A is a front view showing an antenna unit arranged at the right side of the toll road of the exit system shown in FIG. 7.

The antenna unit 35 has the bar shaped outside main body 41*b* that is installed in the erected state at the right roadside of the traffic lane as shown in FIG. 9A. In the outside main body 41*b*, the antenna portions 35UA, 35MA, 35LA and the display portions 35UD, 35MD and 35LD are arranged on the upper, middle and lower stages, respectively. The antenna portion 35UA and the display portion 35UD provided on the upper stage are for vehicles having relatively higher seats such as large vehicles, buses, etc. The antenna portion 35MA and the display portion 35MD on the middle stage are for vehicles in such a height as residential vehicles, etc. The antenna portion 35LA and the display portion 35LD on the lower stage are for vehicles having relatively lower seats such as passenger cars, light vehicles, bikes, etc.

Figure 9B:
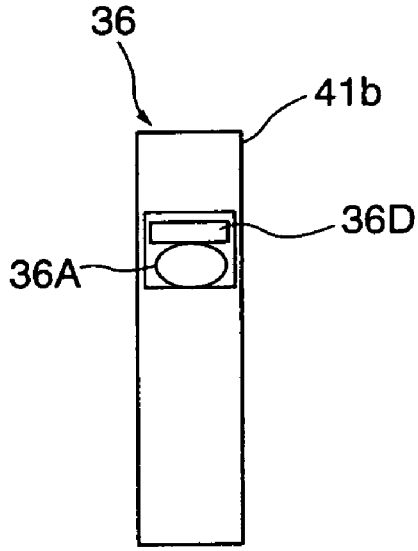
FIG. 9B is a front view showing an antenna unit arranged at the left side of the toll road of the exit system shown in FIG. 7.
Figure 10:
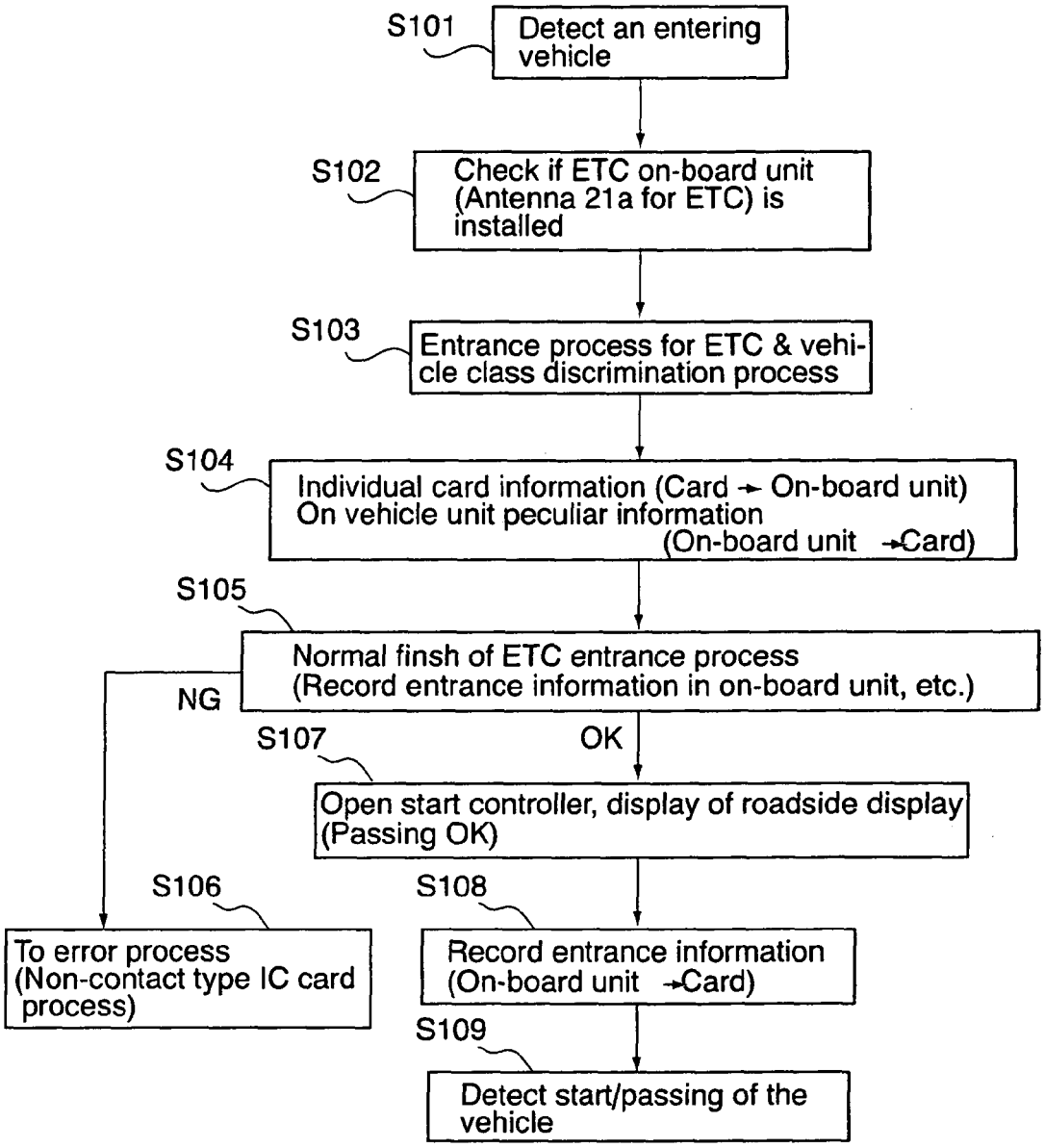
FIG. 10 is a flowchart showing the entrance processing operation of a toll collection system to which the card processing system of this invention is applicable.

The antenna unit 36 has the bar shaped outside main body 41*b* installed in the erected state at the left roadside of the traffic lane as shown in FIG. 9B. In the outside main body 41*b*, the antenna portion 36A and the display portion 36D are arranged at the position as high as almost same as the lower stage of the antenna unit 35. The antenna portion 36A and the display portion 36D are arranged at positions to which a left handle vehicle driver is able to reach by extending the arm. The display portion 36D lights, blinks or displays messages when the card processing function (the wireless communication function) of the antenna portion 36A is effective.

Further, the alignment of the antenna units 35 and 36 are simply one example and all component units may be arranged in the outside main body depending on the installing conditions or the combination of the component units in the main body may be changed. For example, the antenna portions 35UA, 35MA, 35LA and 36A can be separated from the main body including the controller 43 and a display 47, and the antenna portions 35UA, 35MA, 35LA and 36A and the display portions 35UD, 35MD, 35LD and 36D may be arranged at separate positions (the outside), respectively.

The display portions 35UD, 35MD, 35LD and 36D light, blink or display messages when the card processing function (the wireless communication function) of the antenna portions 35UA, 35MA, 35LA and 36A selected by the controller 29 are valid. The messages are such guides as, for example, "Please hold up your IC card over this position", and "Please wait a little until the process of a preceding vehicle is finished".

Further, to make the card processing function (the wireless communication function) of the antenna portions 35UA, 35MA, 35LA and 36A valid or invalid, all the antenna portions 35UA, 35MA, 35LA and 36A are normally kept stopped. Then, when a vehicle class is discriminated by the vehicle class discriminator 32, the antenna portions 35UA, 35MA, 35LA and 36A only at the positions corresponding to the class of that vehicle are operated. Or by keeping all of the antenna portions 35UA, 35MA, 35LA and 36A operated in advance, stop the operations of units other than the antenna portion at the positions corresponding to the class of a vehicle when a class of that vehicle is discriminated by the vehicle class discriminator 32 (turn off the wireless communication function).

Hereinafter, the operation of this toll collection system will be described referring to FIG. 10~FIG. 17. First, the entrance processing operation of this toll collection system will be described referring to a flowchart shown in FIG. 10.

At a toll house that is an entrance of a toll road, when a vehicle enters into a traffic lane, that is, an entrance lane wherein the entrance process relative to vehicles, for example, a process to write entrance information onto an IC card, the entrance of the vehicle is detected by the vehicle class discriminator 12 and the vehicle detector for ETC 22*a* (S 101). The result of this detection is notified to the traffic lane controller for ETC 20. The traffic lane controller for ETC 20 directs the antenna for ETC 21*a* to start the communication. Thus, the wireless communication by the antenna for ETC 21*a* starts and it is checked whether the vehicle is equipped with an on-board unit compatible with ETC (availability of an ETC onboard unit) (S102).

When it is disclosed that a vehicle is equipped with an on-board unit and capable of wireless processing (hereinafter, referred to as an ETC vehicle as a result of availability check of an ETC on-board unit, the ETC entrance process is executed using the antenna for ETC 21*a*.

Also, in the vehicle class discriminator 12, a vehicle class is discriminated from vehicle information such as number of axles, vehicle height, vehicle length, number plate, etc. (S103) and the discriminated result is notified to the controller 19.

If the ETC process becomes erroneous (abnormally completed) (NG in S105), the erroneous process completion is notified to the controller 19 from the traffic lane controller for ETC 20. The controller 19 executes the non-contact IC card process as an error process (S106). Irrespective of normal/abnormal completion of the ETC process, the operating portion of the IC card obtains vehicle information relative to said vehicle (vehicle number, etc.) and peculiar information of an on-board unit (ID No. of an on-board unit) from the on-board unit, sends individual information of IC card (Card ID No.) stored in a semiconductor memory to an on-board unit (S104) and stores this IC card individual information in a memory of the on-board unit. Further, the ETC process at the entrance traffic lane is normally completed and the entrance information received by an on-board unit from the antenna for ETC 21*a* is stored in the memory of the on-board unit (S105).

When the ETC process is normally completed (OK in S105), the traffic lane controller for ETC 20 controls the opening of the gate bar of the start controller 17 and displays the passing OK on the roadside display 15 (S107).

The entrance information received by the on-board unit from the antenna for ETC 21*a* and stored in the memory is obtained by the operation portion of the IC card and stored in a semiconductor memory of the IC chip 51 (S108).

When the gate bar of the start controller 17 opens the gate bar and the vehicle passes the traffic lane and detected by the vehicle detector for ETC 22*d* or the start detector 16, the traffic lane controller for ETC 20 close the gate bar of the start controller 17 and the traffic lane is closed (S109).

Figure 11:
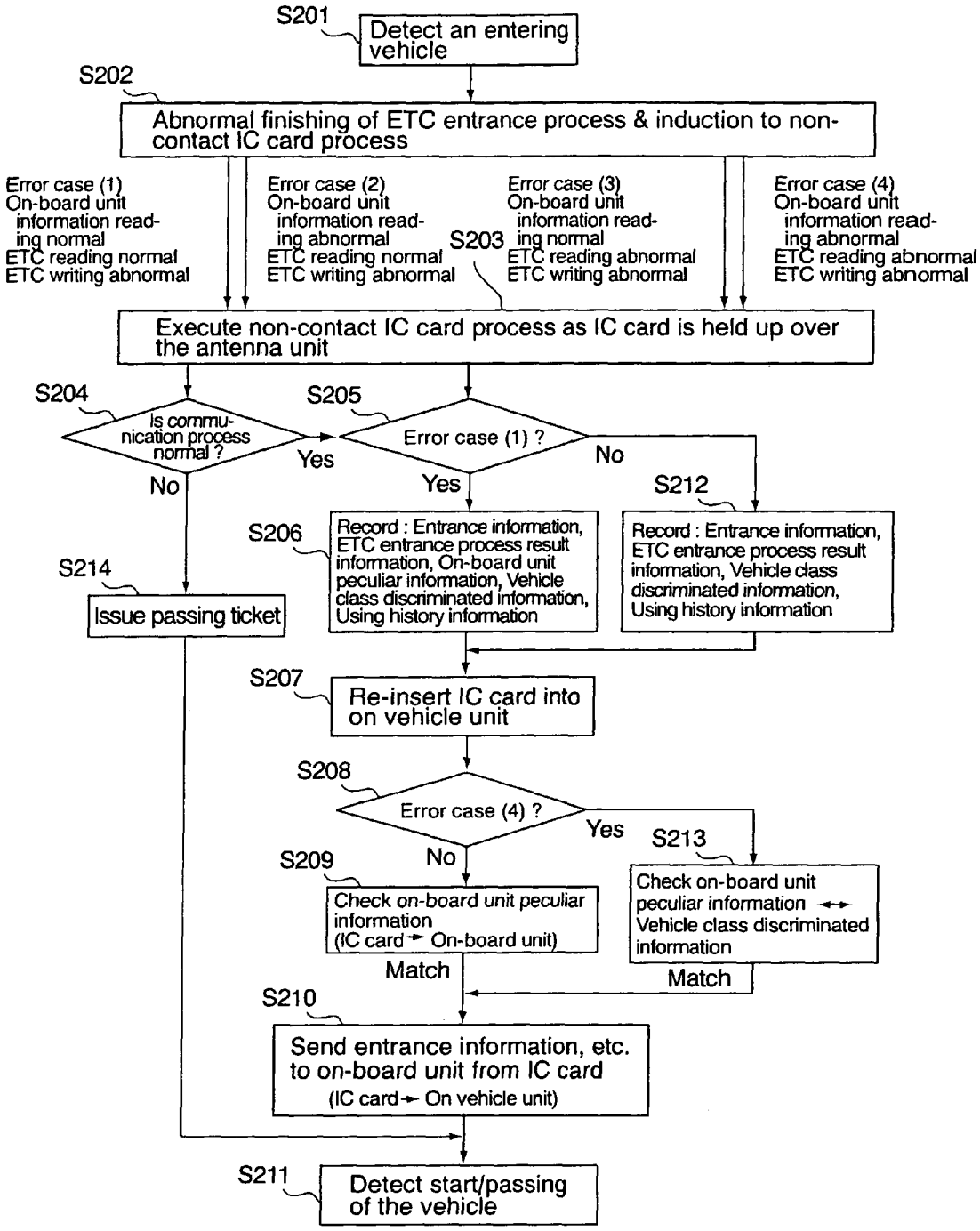
FIG. 11 is a flowchart showing the entrance processing operation when an error is generated in the entrance process for a vehicle.

In succession, the entrance process when an error is generated in the ETC process for vehicle will be described referring to FIG. 11.

When a vehicle entering into the entrance traffic lane is detected by the vehicle detector for ETC 22*a* (S201), the wireless communication by the antenna for ETC 21*a* starts and whether an ETC on-board unit is installed on the entering vehicle is judged. As a result of this judgment, when the entering vehicle is found compatible to the ETC, the ETC entrance process is executed by the antenna for ETC 21*a* and the vehicle class is discriminated from vehicle information such as number of axles, height, length, number plate, etc.

Here, when an error was generated in the ETC process and the ETC entrance process was abnormally finished, the traffic lane controller for ETC 20 displays the induction for executing the non-contact IC card process on the roadside display 15 (S202). Further, the traffic lane controller for ETC 10 notifies the generation of error to the controller 19.

A user who is a vehicle driver looked the induction display on the roadside display 15 moves a vehicle to the position of either the antenna unit 10 or 11 that is an antenna for non-contact IC card and stops there. Then, when the vehicle driver pulls an IC card out of the on-board unit and holds up it over an antenna unit, for example, the antenna unit 10 through the window, the antenna unit 10 starts the wireless communication with the IC card and the entrance process making the most of the function of a non-contact IC card is executed (S203). When the wireless communication of the antenna unit 10 with the IC card is normally executed (Yes in S204), the operating portion checks the contents of the ETC process error in the IC card (S205). Further, in the case of a passenger car that has relatively lower seats, when a user who is a driver holds up an IC card over the antenna portion 10LA that is positioned on the lower stage of the antenna unit 10, the wireless communication is started. When a vehicle is a left handle vehicle, when an IC card is held up over the antenna portion 11A (see FIG. 4B) of the antenna unit 11 installed at the left side of the traffic lane, the wireless communication is started.

There are 4 cases of the ETC process errors shown below.

① On-board unit peculiar information reading normal, ETC reading normal, ETC writing abnormal ② On-board unit peculiar information reading abnormal, ETC reading normal, ETC writing abnormal ③ On-board unit peculiar information reading normal, ETC reading abnormal, ETC writing abnormal ④ On-board unit peculiar information reading abnormal, ETC reading abnormal, ETC writing abnormal For example, in the error case of ① wherein the on-board unit peculiar information reading process can be executed normally but the writing process of entrance information, etc. can not be executed properly (Yes in S205), ETC entrance process result information showing the abnormal ETC writing process by the antenna for ETC 21*a*, on-board unit peculiar information and vehicle class discriminated information are sent to the IC card from the antenna for ETC 21*a* in addition to the entrance information. In the IC card, the operating portion records the information in a semiconductor memory of the IC chip 51. At the same time, the operating portion records using history information including use of a non-contact IC card in the semiconductor memory (S206). Further, when the IC card is inserted again into the on-board unit, the operating portion of the IC card sends the individual information (ID No.) of the IC card to the on-board unit.

In succession, when the IC card is inserted into the on-board unit again by the vehicle driver (S207), the operating portion of the IC card checks the contents of the error stored in the memory of the on-board unit (S208).

As this is the error case ① not the error case ④ (No in S208), the operating portion compares and collates the on-board unit peculiar information first read in the ETC process by the antenna for ETC 21*a* with the on-board unit information read from the on-board unit memory when the IC card was inserted again into the on-board unit (S209). When the match could be confirmed as the result of the comparison and collation, the operating portion sends the entrance information or the passing history information recorded on the IC card in the non-contact IC card process to the on-board unit (S210).

Further, when a series of IC card processes are finished, the controller 19 notifies the traffic lane controller for ETC 20 of the completion of the processes. The traffic lane controller for ETC 20 controls the start controller 17 to open the gate bar and the roadside display 15 to display the approval of passing. Thereafter, when the starting of the vehicle is detected by the start detector 16 or the vehicle detector for ETC 22*d* (S211), the traffic lane controller for ETC 20 closes the traffic lane by closing the gate bar of the start controller 17.

On the other hand, in the error cases ②, ③ and ④ wherein at least one of the on-board unit information reading process or the ETC reading process cannot be executed, the ETC entrance process result showing the abnormal ETC reading process by the antenna for ETC 231*a* and the information of the vehicle class discrimination result (the vehicle class discrimination information) are sent to an IC card in addition to the entrance information and the information is recorded in the semiconductor memory of the IC chip 51 by the operating portion. At the same time, the operating portion record the use history information including use of a non-contact IC card on the semiconductor memory (S212). In this ease, the on-board unit peculiar information is not obtained.

When the IC card is inserted again into the on vehicle nit by the vehicle driver (S207), the operating portion checks the contents of error stored in the memory of the on-board unit (S208).

In the error cases ② and ③ as the result of this check, that is, when the errors are other than the error case ④ (No in S208), the operating portion compares and collates the on vehicle peculiar information first read by the antenna for ETC 21*a* in the ETC process with the on-board unit peculiar information read from the memory of the on-board unit when the IC card is inserted again into the on-board unit (S209).

When the match can be checked as a result of this comparison and collation, the operating portion sends the entrance information recorded on the IC card in the non-contact IC card process and the passing history information to the on-board unit (S210).

Further, when a series of IC card processes is completed, the controller 19 so notifies the traffic lane controller for ETC 20. The traffic lane controller for ETC 20 controls the start controller 17 to open the gate bar and controls the roadside display 15 to display approval of passing. Thereafter, when the start of the vehicle is detected by the start detector 16 or the vehicle detector for ETC 22*d* (S211), the traffic lane controller for ETC 20 closes the traffic lane by closing the gate bar of the start controller 17.

In the error case ④ wherein both the on-board unit reading process and the ETC reading process could not be executed properly when the error contents is checked in the step S208 (Yes in S208), the operating portion of an IC card compares and collates the vehicle class discriminated information read in the entrance process and the peculiar information of the on-board unit into which the IC card was inserted. When matching of both information is confirmed by this comparison and collation, the entrance information and passing history information recorded in the IC card in the non-contact IC card process are sent to the on-board unit (S210). Thereafter, when a series of the card processes is completed, the controller 19 so notifies the traffic lane controller for ETC 20. The traffic lane controller for ETC controls the start controller 17 to open the gate bar and the roadside display 15 to display the approval for passing. Thereafter, when the started vehicle is detected by the start detector 16 or the vehicle detector for ETC 22*d* (S211), the traffic lane controller for ETC close the traffic lane by closing the gate bar of the start controller 17. Further, despite of use of an IC card as a non-contact IC card, the non-contact IC card process becomes erroneous as a result of an error generated in the ETC process (No. of S204), the controller 19 directs the applicable passing ticket issuer 13 or the passing ticket issuer for left handle vehicles to issue a passing ticket to that vehicle (S214). After a passing ticket pulled out is detected, the traffic lane controller for ETC 20 is so notified. The traffic lane controller for ETC 20 controls the start controller 17 to open the gate bar and the roadside display 15 to display the approval of passing. Thereafter, when the staring of that vehicle is detected by the start detector 16 or the vehicle detector for ETC 22*d* (S211), the traffic lane controller for ETC closes the traffic lane by closing the gate bar of the start controller 17.

Figure 12:
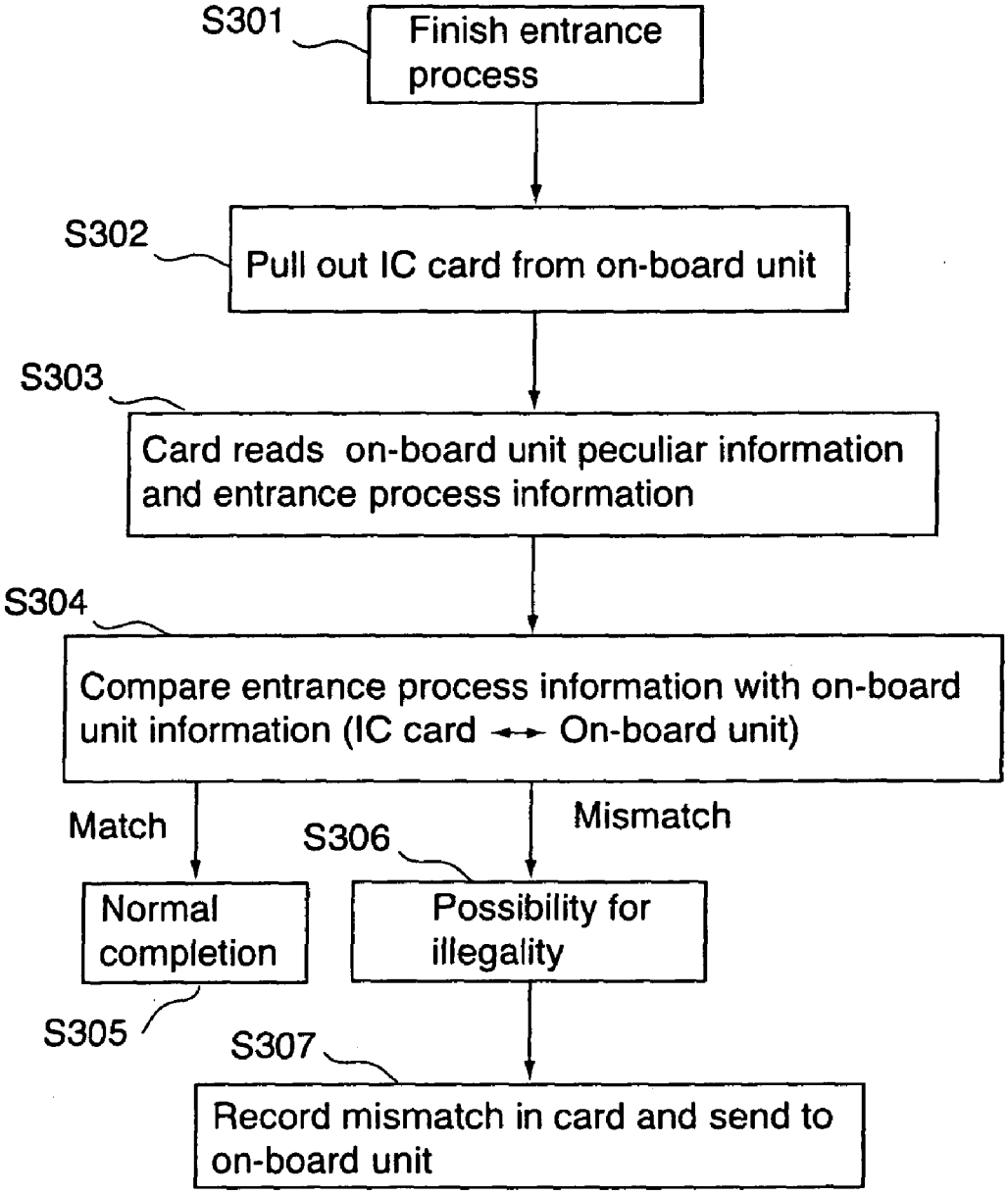
FIG. 12 is a flowchart showing the process when an IC card is inserted into/pulled out of an on-board unit.

In succession, the process when an IC card is pulled out or inserted to/from a on-board unit will be explained referring a flowchart shown in FIG. 12.

In the case of an on-board unit of a vehicle of which entrance process was finished (S301), when a user once pulls an IC card out of and again inserts it into the onboard unit of the vehicle (S302), the power supply from the contact type IC terminal 52 is detected by the operating portion in the IC card. Then, the operating portion of the IC card reads the on-board unit peculiar information again from the on-board unit and reads the entrance process information (the individual card information, the entrance processed onboard unit peculiar information, discriminated entrance vehicle class information, entrance information, etc.) recorded on the memory of the on-board unit (S303).

After completing the reading process, the operating portion compares and collates entrance process information recorded in the semiconductor memory in an IC card, entrance process information read from the on-board unit and peculiar information of the on-board unit read when the IC card was inserted again (S304). When the match of information was confirmed as the result of this comparison and collation (Match in S304), the operating portion normally finishes the process (S305).

Further, when mismatch is confirmed as a result of the comparison and collation (Mismatch in S304), mismatch and substance are recorded in the semiconductor memory of an IC card and sent to the on-board unit into which the IC card was inserted again, and the contents of mismatch are stored in the memory of the on-board unit (S307).

Figure 13:
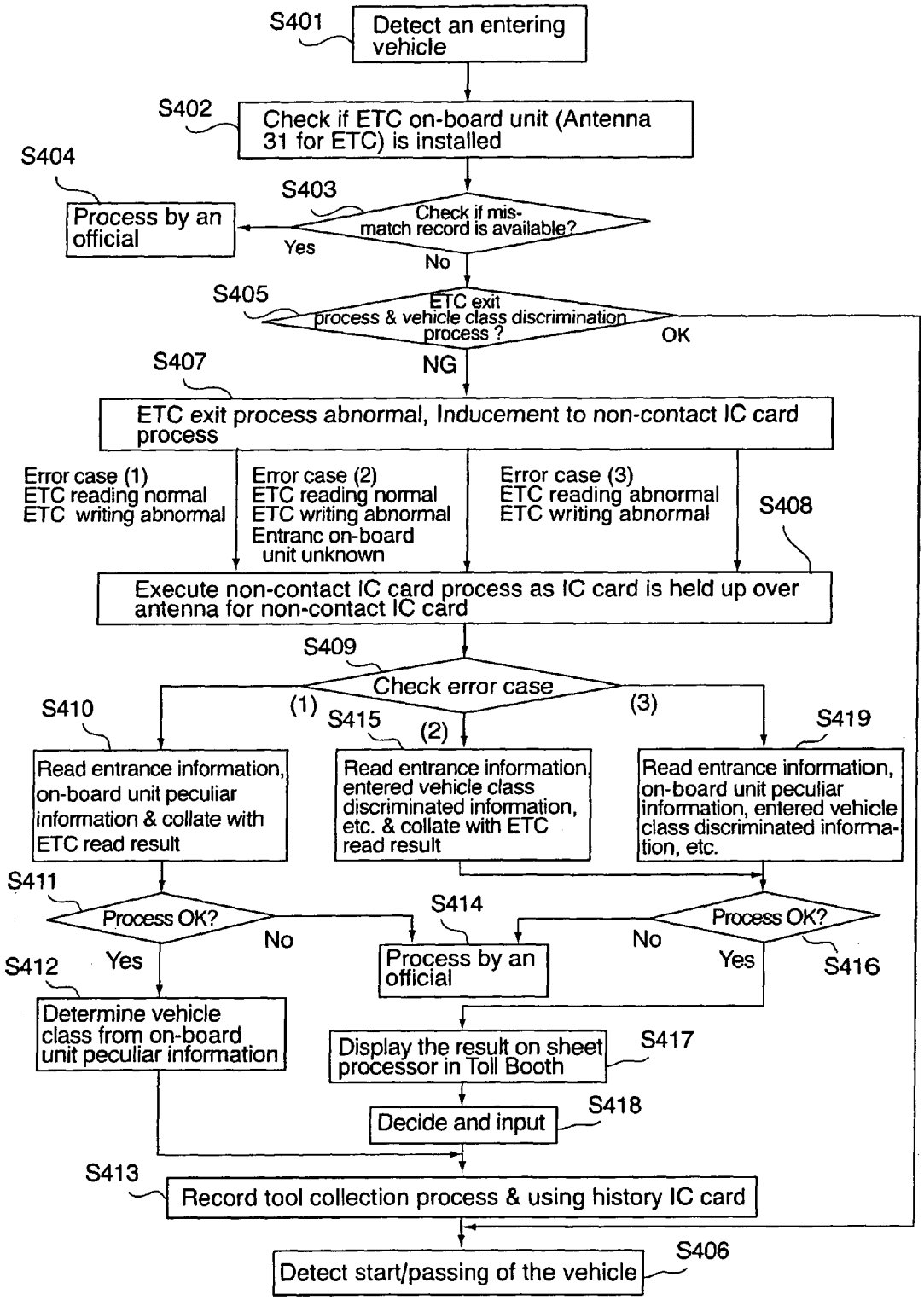
FIG. 13 is a flowchart showing the exit processing of a toll collection system to which the card processing system of this invention is applicable.

Next, the exit process of this toll collection system will be explained referring to a flowchart shown in FIG. 13.

In this toll collection system, when a vehicle enters into the traffic lane (the exit lane) of a toll house and the entering vehicle is detected by the vehicle detector for ETC 33*a* (S401), the traffic lane controller for ETC 39 judges whether an ETC on-board unit is installed in the entering vehicle by the antenna for ETC 31 (the availability check of an ETC on-board unit) (S402).

When it is detected that the entering vehicle has an ETC on-board unit as a result of availability check of an ETC on-board unit (S401); that is, the vehicle is an ETC vehicle, the traffic lane controller for ETC 39 checks availability of the record of mismatch on and after the entrance process of this time based on the data obtained from the ETC onboard unit (S403).

When there is the mismatch record as the result of the availability check the mismatch record (Yes of S403), the traffic lane controller for ETC 39 judges that the vehicle is to be processed by an official in charge (S404) and so displays on the roadside display 23.

Further, when there was no mismatch record as a result of the availability check of the mismatch record (No of S403), the ETC exit process and the vehicle class discrimination process by the antenna for ETC 31 are executed (S405).

When the ETC exit process by the antenna for ETC 31 is normally finished (OK of S405), the traffic lane controller for ETC 39 controls the start controller 27 to open the gate bar 27*a* or 27*b* and the roadside display 23 to display the approval of passing. Thereafter, when the staring of the vehicle is detected by the start detector 26 or the vehicle detector for ETC 33*b* (S406) the traffic lane controller for ETC 39 closes the traffic lane by closing the gate bar 27*a* or 27*b* of the start controller 27. Further, when an error is generated in the ETC exit process by the antenna for ETC 31 (NG of S405), the traffic lane controller for ETC 39 checks the error contents and induces to the exit abnormal process for ETC and the non-contact type IC card process (S407).

There are following three ETC exit processes:

① ETC reading normal, ETC writing abnormal

② ETC reading normal, ETC writing abnormal, entrance on vehicle unknown

③ ETC reading abnormal, ETC writing abnormal

When anyone of these ETC exit process errors is generated, the traffic lane controller for ETC 39 displays the induction for the non-contact IC card process on the roadside display 23. Further, the generation of error is notified to the controller 29 from the traffic lane controller for ETC 39.

A user who is a vehicle driver looked the induction display on the roadside display 23 moves a vehicle to the position of the antenna unit 35 or 36 that is an antenna for con-contact IC card and stops there. Then, when the driver pulls an IC card out of an on-board unit and holds up it over the antenna unit, for example, the antenna unit 35 through the window, the antenna unit 35 starts the wireless communicate with the IC card and the exit process making the most of the function of a non-contact IC card is executed (S408).

When the wireless communication of the antenna unit 35 with the IC card is executed normally, the controller 29 checks the contents of the ETC process error (S409). The operating portion in the IC card may make this process. Further, when a vehicle of which seats are relatively low such as a passenger car, a user who is a driver holds up an IC card over the antenna portion 35LA on the lower stage of the antenna unit 35 as shown in FIG. 9A, the wireless communication is started. In the case when a left handle vehicle is used, the wireless communication is started when an IC card is held up over the antenna portion 36A of the antenna unit 36 installed at the left side of the traffic lane (FIG. 9B).

In the error case ① where, for example, the ETC reading of entrance information, peculiar information of an on-board unit could be made normally but the exit recording process could not be made normally (① of S409), the controller 29 compares and collates the entrance information read from the semiconductor memory of an IC card and peculiar information of an on-board unit with the ETC exit read result (S410).

When the results of the comparison and collation are NG (No of S411), the controller 29 decides that the process should be executed by an official in charge (S414) and so displayed on the roadside display 23 and a display near the antenna unit 35.

Further, when the results of the comparison and collation are OK (Yes of S411), the controller 29 executes the exit process based on a vehicle class that is decided from the on-board unit peculiar information (S412) and collects a toll from the entrance to the exit. Further, the controller 29 controls the antenna unit 35 and stores that the ETC process by the antenna for ETC 31 (the exit antenna) became abnormal and the using history of an IC card as a non-contact IC card in the IC chip 51 (the semiconductor memory) of the IC card from the antenna unit 35 (S413).

After collecting a toll, the controller 29 so notifies to the traffic lane controller for ETC 39. The traffic lane controller 39 controls the start controller 27 to open the gate bar and the roadside display 23 to display the approval of passing. Thereafter, when the starting of the vehicle is detected by the start detector 26 (S406), the traffic lane controller for ETC 39 close the traffic lane by closing the gate bar 27*a* or 27*b* of the start controller 27.

Further, in the case of the error case ② (② of S409) when the ETC exit process error that, for example, the ETC reading process was executed normally but the recording process at the exit couldn't be made properly in the judging process in Step S409 and the on-board unit peculiar information couldn't read properly in the entrance process, the control module 28 of the controller 29 executes the comparison and collation of the entrance information and the entrance vehicle class discriminated information read by the antenna unit 35 from the semiconductor memory of an IC card through the wireless communication with peculiar information of an on-board unit of the vehicle (ETC exit read result) (S415). When the results of the comparison and collation are OK (OK of S416), it is so displayed on a sheet processor 24 that is installed in an official in charge booth 36 and next operation (final decided input, etc.) is urged (S417).

When an official in charge visually checks the display contents of the sheet processor 24 and the vehicle, confirms the vehicle class, matching by the comparison and collation could be confirmed, input a decided toll by operating the confirming button, etc. (S418), the control module 28 of the controller 29 decides a collecting charge and executes the exit process. A toll of a toll road is thus collected. Further, the abnormal ETC process by the antenna for ETC 31 at the exit and use of the IC card as a non-contact IC card are recorded as a use history in the IC card (S413).

Further, when the match could not be checked by the comparison and collation, the control module 28 of the controller 29 suspends the exit process and judging that there may be the possibility of such an illegal action as the exchange of IC cards, gives a warning by displaying a warning message on the display screen of the sheet processor 24 or sounding a warning sound through a speaker. Further, when there is the possibility for an illegality, it is stored in the semiconductor memory of an IC card as the using history.

Further, in the error case ③ (③ of S409) where the reading process of, for example, entrance information peculiar information of an on-board unit could not be read properly, the generation of an error is notified to the controller 29 from the traffic lane controller for ETC 39 in the judging process in the above step S409. The traffic lane controller for ETC 39 displays the induction for the non-contact IC card process on the roadside display 23.

A user who is a vehicle driver looked the induction display on the roadside display 23 pulls an IC card out of an on-board unit, holds up I over the antenna unit 35 by making the most of the function of an non-contact IC card. The antenna unit 35 starts the wireless communication with the IC card and reading entrance information, on-board unit peculiar information and vehicle class discriminated information at the entrance recording in the IC card, notifies the controller 29 of the read information. The control module 28 of the controller 29 makes the comparison and collation of the vehicle class information discriminated at the entrance and the exit read from the IC card and the on-board unit peculiar information recorded in the semiconductor memory of the IC card (S419), and when the result of this comparison and collation is OK (Yes of S416), displays its contents on the sheet processor 24 installed in the official in charge booth 36 likewise the error case ② (S417).

When the displayed contents on the sheet processor 24 and the vehicle class are visually checked and the match is confirmed through the comparison and collation, an official in charge inputs the confirmed information (S418). The control module 28 decides a tollage to be collected, executes the exit process by the antenna unit 35 and collects the passing tollage.

Further, when the match could not be confirmed by the comparison and collation, the control module 28 suspends the exit process and judging that there is the possibility of an illegal deed such as the exchange of IC cards and issues an alarm. Further, the ETC process by the antenna for ETC 31 that became abnormal and use of a non-contact IC card as a non-contact IC card are stored in that IC card (S413). Further, when there is the possibility of illegality, it is so stored in the IC card.

Irrespective of use of an IC card as a non-contact IC card, the non-contact IC card process became erroneous (No. of S411, No. of S416) or when a passing ticket was issued at the entrance, the process of that IC card by an official in charge is executed (S414).

When the process by an official in charge is executed, a user hands the IC card to an official in charge. When a passing ticker is available, it is also handed to an official in charge.

An official in charge executes the exit process for the IC card by the IC card processor 30 installed in the official booth 36 and having the read/write function of IC cards for ETC (contact type IC cards). Further, a passing ticket is put into and processed by the sheet processor 24.

Figure 14:
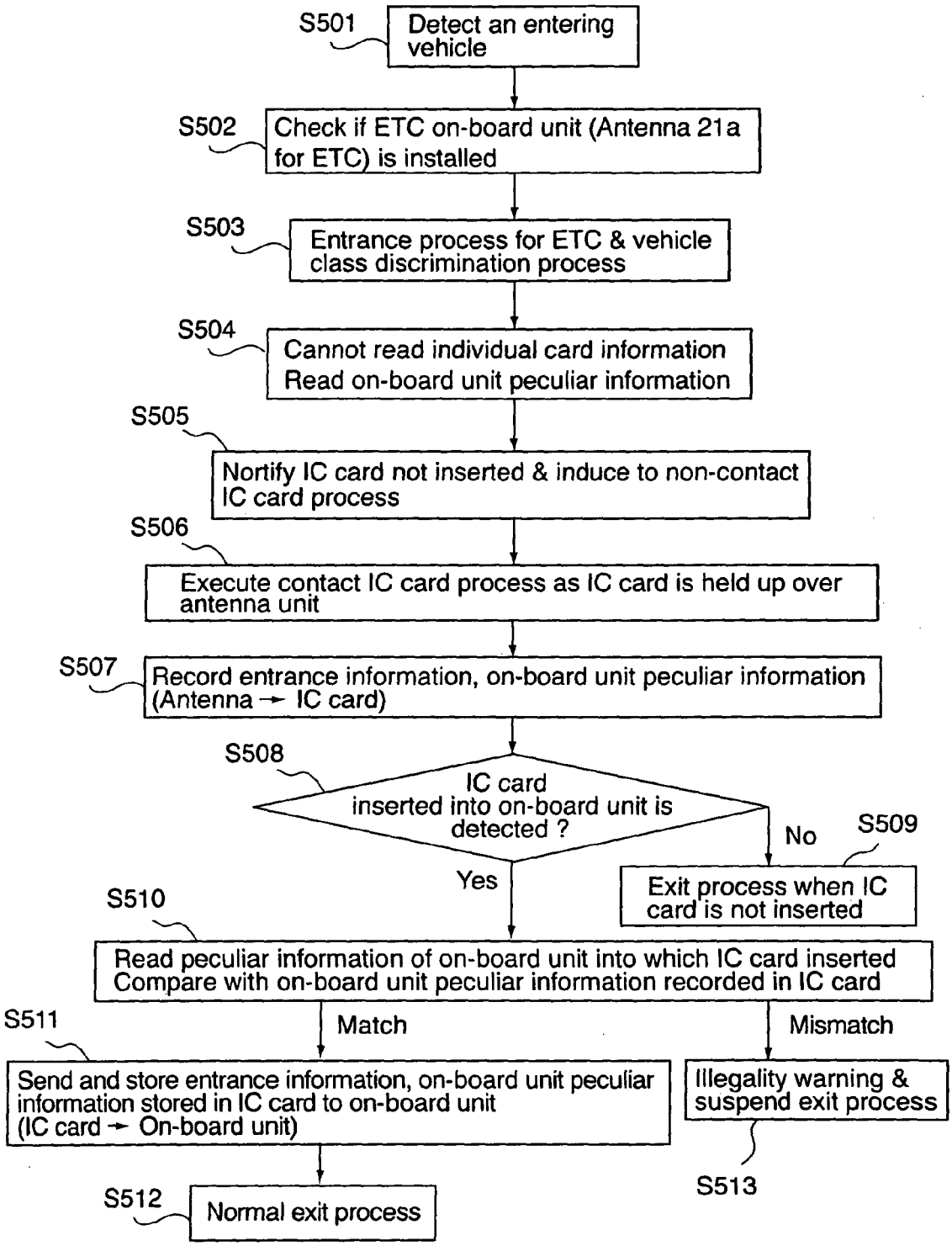
FIG. 14 is a flowchart showing the backup processing operation at the entrance when no IC card was inserted into an on board unit.
Figure 15:
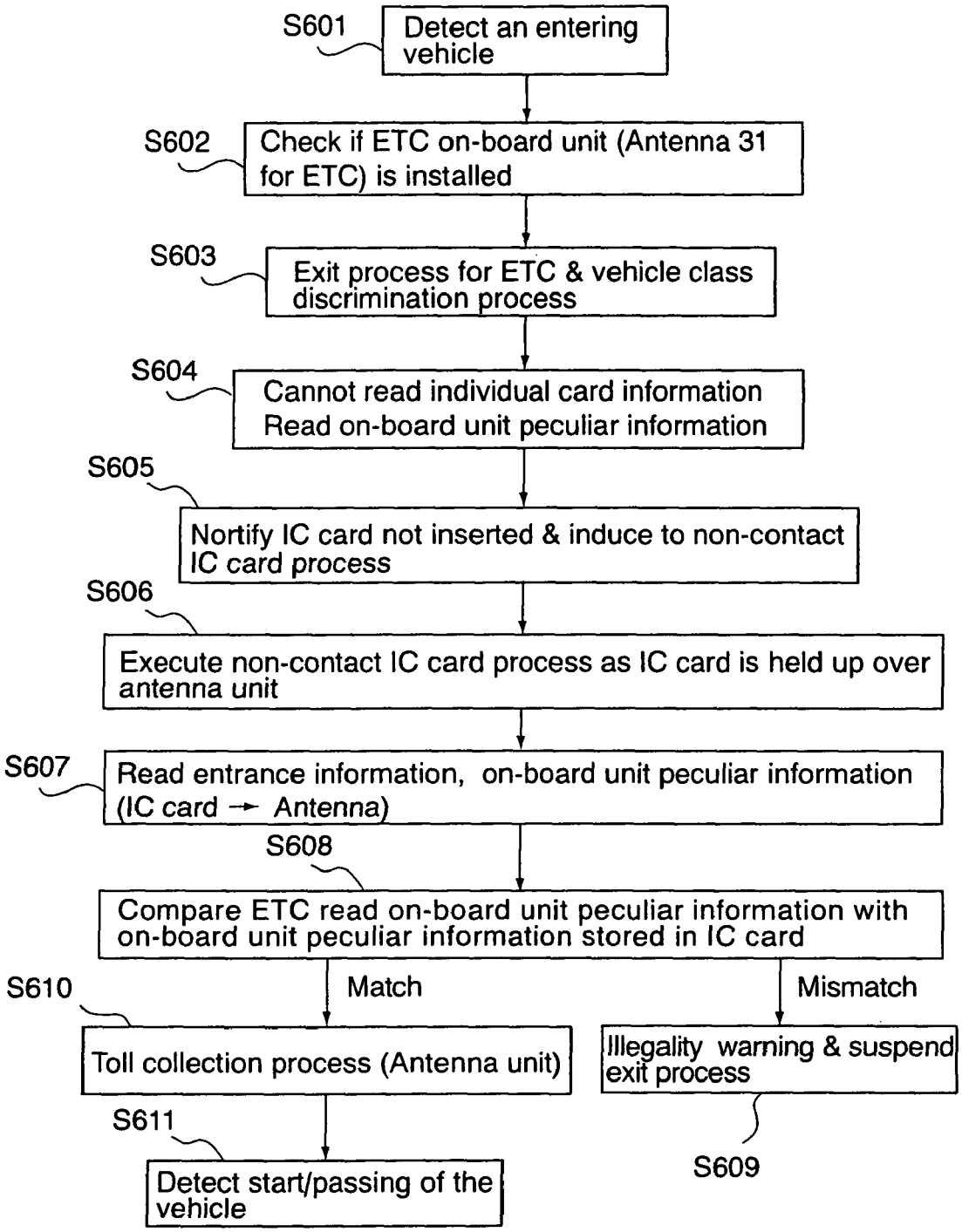
FIG. 15 is a flowchart showing the backup processing operation a the exit when no IC card was inserted into an on board unit.

The backup operation to compensate the ETC process that cannot be executed when an IC card is inserted into an on-board unit will be explained referring to FIG. 14 and FIG. 15. FIG. 14 is a flowchart showing the entrance process and FIG. 15 is a flowchart showing the exit process.

First, the entrance process will be explained referring to the flowchart shown in FIG. 14.

When a vehicle entering into the traffic lane (the entrance lane) of a toll road is detected at a tollhouse by a vehicle detector for ETC 22*a*, the ETC entrance process is executed through the wireless communication by the antenna for ETC 21*a*. Further, the vehicle class is discriminated by the vehicle class discriminator 12. When no IC card is inserted into an on-board unit at this time, peculiar information of an onboard unit can be read from the on-board unit but the individual information of the card cannot be read at all.

In such the case, the traffic lane controller for ETC 20 judges that an on-board unit is in the state without IC card inserted and notifies a user that no IC card is inserted and urges to insert an IC card into an on-board unit. At the same time, even when an IC card is inserted into an on-board unit, a trouble of the IC card contact of the on-board unit is expected and therefore, the traffic lane controller for ETC 20 displays a message on the roadside display 23 (S505) to urge a user to hold up an IC card over the antenna unit 10 or 11 that is the antenna for non-contact IC card.

Then, when the user of that vehicle holds up an IC card over, for example, the antenna unit 10, the antenna unit 10 starts the wireless communication with the IC card (S506). By this communication, entrance information and the peculiar information of the on-board unit already obtained through the ETC communication with the on-board unit are recorded on the IC card (S507).

When the vehicle arrives at the exit without the IC card inserted in the on-board unit in the toll road after finishing the entrance process (No of S508), it becomes the exit process with without a card inserted (S509).

Further, when a user inserts an IC card into the on-board unit in the toll road and the operating portion of the IC card detects the card inserted according to power supply and the communication request (Yes of S508), the operating portion of the IC card compares and collates the peculiar information of the on-board unit with the peculiar information of the on-board unit recorded in the semiconductor memory of the IC card (S510). When the match could be confirmed by this comparison and collation (Match of S510), the operating portion stores (copies) the entrance information by sending it to the memory of the on-board unit from the semiconductor memory (S511) and it becomes possible to execute the normal exit process at the exit when the content of the on-board unit is agreed with the content of the memory of the IC card (S512). Further, when the match could not be confirmed as a result of the comparison and collation (No Match of S510), the operating portion judges there is the possibility for illegal actions such as IC card exchange and gives a warning for illegality (S513). At this time, the information of possibility for illegality is stored in the semiconductor memory of the IC card as the using history. Then, when the exit process is started, an information to request suspension of the exit process is sent to the antenna for ETC 31 or the antenna units 35 and 36 from the on-board unit.

Next, the exit process will be explained referring to the flowchart shown in FIG. 15.

When the entry of a vehicle into the traffic lane (the exit lane) of the exit tollhouse of a toll road is detected by the vehicle detector for ETC 33*a* (S601), the wireless communication by the antenna for ETC 31 is started and the traffic lane controller for ETC 39 is informed. The traffic lane controller for ETC 39 directs the antenna for ETC 31 to start the communication. Then, the wireless communication by the antenna for ETC 31 is started and whether the vehicle is equipped with an ETC on-board unit is checked (checking of availability of an ETC on-board unit) (S602). As a result of the checking of availability of ETC on-board unit, when it is confirmed that the vehicle is equipped with an ETC on-board unit, the antenna for ETC 31 executes the ETC exit process (S603). Further, the vehicle class is discriminated by the vehicle class discriminator 32. At this time, if no IC card was inserted into an on-board unit, the on-board unit peculiar information can be read but an individual information of card cannot be read at all likewise the ETC entrance process (S604).

In such a case, the traffic lane controller for ETC 39 judges that an IC card was not inserted into an on-board unit, and notifies an user that no IC card was inserted and by displaying a message on, for example, the roadside display 23, urges a user to insert an IC card into an on-board unit. At the same time, when the IC card contact of an on vehicle is faulty, the traffic lane controller for ETC 39 displays a message to guide a user to hold up an IC card over the antenna unit 35 or 36 that is an antenna for non-contact IC card and urges a user to hold up an IC card over the antenna unit 35 or 36 (S605).

When a user holds up an IC card over, for example, the antenna unit 35 according to this induction (guidance), the antenna unit 35 reads out information for the exit process from the IC card (S607) through the wireless communication with the IC card (S606) and hands it to the controller 29. The control module 28 of the controller 29 compares and collates the individual information of an IC card at the entrance from the antenna unit 35 with the individual information of the IC card and the peculiar information of the on-board unit at this exit (S608).

As a result of this comparison and collation, when the individual IC card information and the on-board unit peculiar information at the entrance were mismatched with the individual IC card information and the on-board unit peculiar information at the exit (Mismatch of S608), the control module 28 judges that there is the possibility of illegality, issues a warning and suspends the exit process (S609).

On the other hand, when an IC card was not inserted into an on-board unit at the exit, the antenna for ETC 31 also reads peculiar information of the on-board unit stored in the memory of the on-board unit. Then, when an IC card is held up over the antenna unit 35 by a user of the vehicle, the antenna unit 35 reads the entrance information from the IC card and the peculiar information of the on-board unit recorded in the IC card and hand the information to the controller 29. The control module 28 of the controller 29 compares and collates the on-board unit peculiar information (stored in the IC card) handed by the antenna unit 35 with the on-board unit peculiar information of the vehicle received from the on-board unit by the antenna for ETC 31 (S608). When the match of the information was confirmed by the comparison and collation (Match of S608), the toll collection process is executed through the wireless communication between the antenna unit 35 and the IC card (S610).

After the toll collection, the controller 29 informs it to the traffic controller for ETC 39. The traffic controller for ETC 39 controls the start controller 27 to open the gate bar 27*a* and the roadside display 23 to display the approval of passing. Thereafter, when the start of the vehicle is detected by the start detector 26 (S611), the traffic lane controller for ETC 39 close the traffic lane by operating the gate bar 27*a* or 27*b* of the start controller 27. Further, when both of the peculiar information of the on-board unit is unmatched, the control module 28 regards that there is the possibility of illegality and suspend the process (S609).

Figure 16:
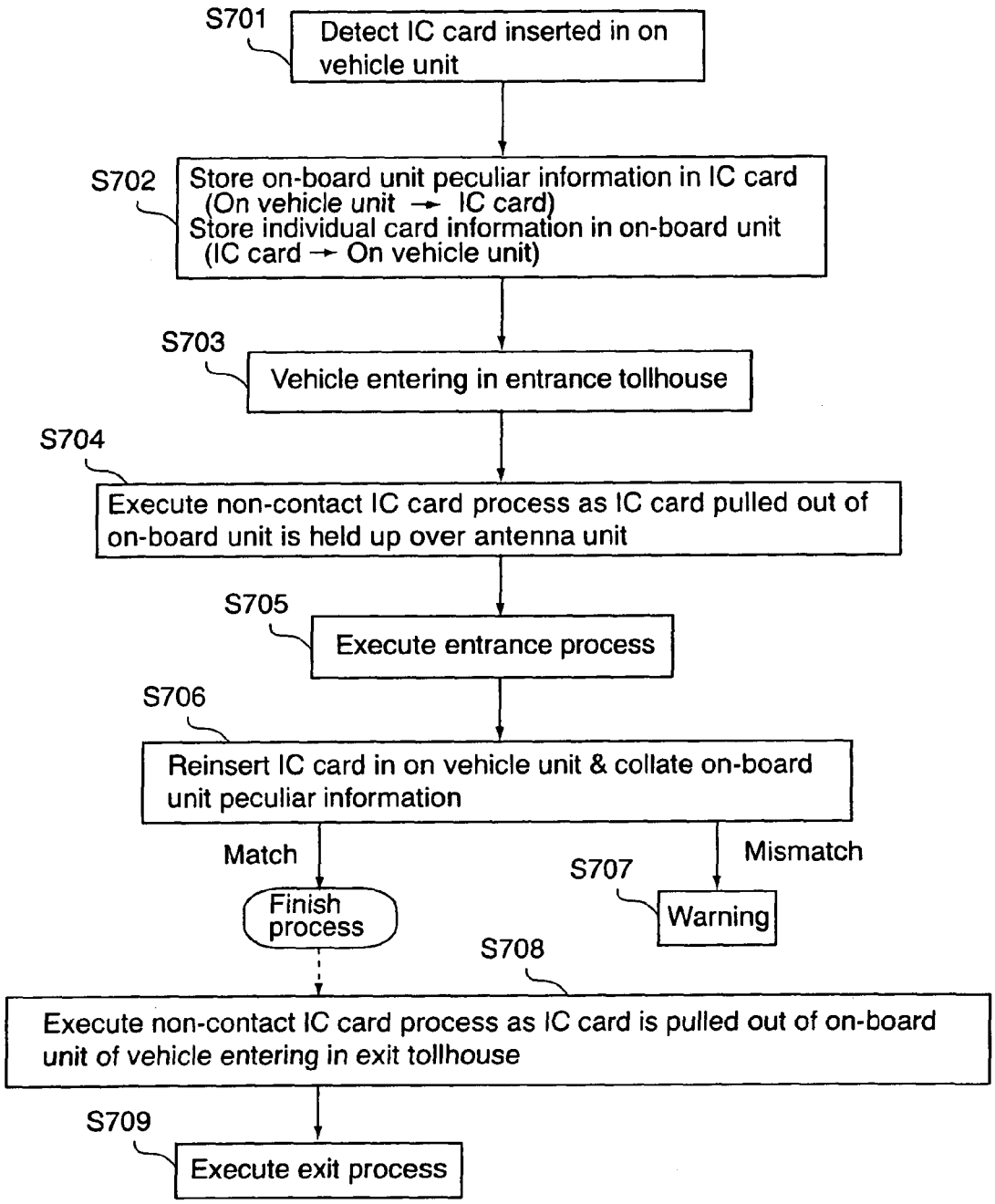
FIG. 16 is a flowchart showing the processing for enabling use of a rent-a-car equipped with an on board unit.

Next, the process to enable the use of a vehicle equipped with an onboard unit that is not set for an ETC IC card (a rental vehicle equipped with an on-board unit) in this toll collection system will be explained referring to a flowchart shown in FIG. 16.

In the case of a rental car (vehicle) equipped with an on-board unit, when an IC card is inserted into the on-board unit before entering into a toll road, an operating portion of the IC card detects that it is inserted into the on-board unit (S701) and reads out peculiar information of the on-board unit and records the information in a semiconductor memory. Further, the operating portion sends the individual card information stored in the semiconductor memory of the IC card to the on-board unit and stores it in a memory of the on-board unit (S702).

Then, when a driver of the rental car (vehicle) equipped with the onboard unit drives the car and enters into the entrance lane of an entrance toll house and pulls out the IC card from the on-board unit and holds up it over the antenna unit 10 or 11 that is an antenna for a non-contact IC card. In this case, it is assumed that the IC card is held up over, for example, the antenna unit 10.

The antenna unit 10 executes the entrance process (S705) by making the wireless communication with the IC card (S704).

The entrance process referred to here is a non-contact IC card process wherein the antenna unit 10 obtains individual card information, on-board unit peculiar information, usable balance amount, etc. from the IC card through the wireless communication with the IC card and hands the information to the controller 19, which then identifies a class of the vehicle from the on-board unit peculiar information and sends the identified vehicle class information, entrance passing time information, entrance gate number, etc. to the IC card from the antenna unit 10 as the entrance information and store there.

After the entrance process, the vehicle driver inserts the IC card again into the on-board unit. When the IC card is inserted into the on-board unit, the operating portion of the IC card reads out the peculiar information of the on-board unit from the memory of the on-board unit and performs the comparison and collation of the peculiar information of the on-board unit stored in the semiconductor memory of the IC card with the peculiar information of the on-board unit (S706).

When the mismatch is confirmed as a result of this comparison and collation (Mismatch of S706), the operating portion sends the warning information for the exit process to the on-board unit and stores in its memory (S707) and therefore, the exit process of the said IC card is prohibited. Further, a warning may be issued from the display of the on-board unit or a speaker (an enunciation portion) at the time when the mismatch is confirmed.

When both information are matched (Match of S706) as a result of the comparison and collation, the operating portion terminates the process.

When the rental car (vehicle) equipped with the on-board unit entered into a toll road from the entrance tollhouse runs and enters into the exit lane of the exit tollhouse to leave an exit tollhouse, the driver pulls out the IC card from the on-board unit and holds up it over the antenna unit 35 or 36 that is the antenna for non-contact IC card. In this case, it is assumed that the IC card is held up over, for example, the antenna unit 35.

The antenna unit 35 makes the wireless communication with the IC card (S708) and the control module 28 of the controller 29 executes the exit process (S709).

Definitely, the antenna unit 35 reads out the individual card information, peculiar information of the on-board unit, entrance information and usable balance amount from the IC card and hands these information to the controller 29. The control module 28 of the controller 29 computes a toll to be collected from the individual card information, peculiar information of the on-board unit, entrance information, usable balance amount that are handed from the antenna unit 35 and a toll table that is set in own module 28, subtracts the computed toll from the usable balance amount and records the balance amount after subtracting the toll. On the toll table, sectional tolls between own tollhouse and other tollhouses are set.

Further, this is an example using a prepaid type IC card with a certain amount pre-charged. When a post paying card having a credit function, etc. is used, a used toll is subtracted later from the account of the IC card based on the individual card information read at the entrance and exit.

Figure 17:
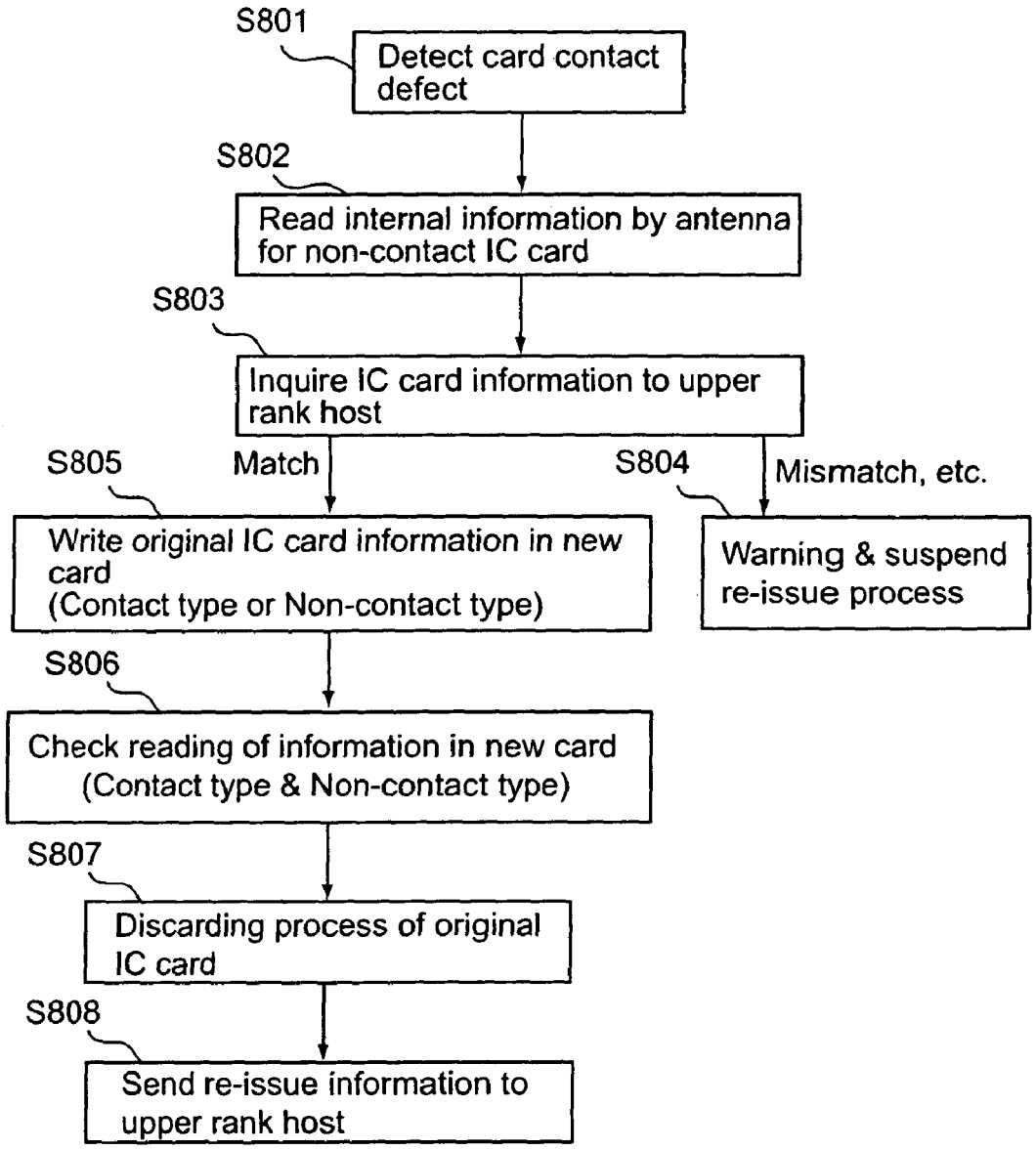
FIG. 17 is a flowchart showing an IC card re-issue process caused for troubles such as defective contact, etc.

Next, an IC card re-issue process for troubles such as defective contact, etc. will be explained referring to a flowchart shown in FIG. 17.

When the contact of a contact type IC terminal of IC card becomes defective, the read and write process (R/W process) of information recorded in a semiconductor memory of IC card cannot be made and IC card cannot be used as a contact type IC card.

When an IC card becomes defective, a card is re-issued by the card processor 30 that is installed in an office of the nearest tollhouse of a toll road or an official booth 36 of an exit tollhouse.

In this case, the card processor 30 is provided with an antenna for non-contact IC card similar to the antenna units 10,11, 35 and 36 and a card slot for normal contact type IC. When an IC card is inserted into the card slot, a CPU of the card processor 30 executes first the IC card contact type information read/write process. When either the read or write process is disable, the card contact is determined defective (S801), the card is discharged and the error is displayed.

When the IC card is detected to be defective, the operating portion of the card processor 30 executes the re-issue operation and the IC card discharged from the card slot is held up over the antenna for non-contact IC card.

Then, the information stored in the semiconductor memory of the IC card is read by the antenna for non-contact IC card (S802) and handed to the CPU of the card processor 30.

When the CPU of the card processor 30 receives the information of the IC card, requests the inquiry of the information of the IC card to an upper rank host 9 through the wireless line 8 (S803).

When the mismatch or existence of any problem is replied from the upper rank host 9 as a result of the inquiry of the IC card (Problem of Mismatch, etc. of S803), the CPU or the card processor 30 issues a warning and suspends the re-issue process (S804).

On the other hand, when the match is replied from the upper rank host 9 as the result of the IC card information inquiry (Match of S803), the CPU of the card processor 30 displays a message to urge to insert a newly re-issued IC card (a new card). When a new card is inserted into the card slot, CPU of the card processor 30 writes the information read from the original IC card and writes into the new card (S805). When the read information is checked and becomes OK (S806), the new card is discharged from the card slot and re-issues it. Further, the original IC card id discarded by breaking the IC chip 51 or writing data (flag) to disable the future use of the card (S807).

Then, the CPU of the card processor 30 sends the re-issue information to the upper rank host 9 (S808) for updating data of the database at the upper rank host 9 side. Further, the terminal for executing the re-issue process; that is, the card processor 30 can be provided in not only the exit tollhouse but also an entrance tollhouse, a service area, a parking area of a toll road.

According to the toll collection system in the embodiment as described above, when the entrance process by the antenna for ETC 21*a* was abnormally finished (when the entrance ETC process error was generated), the wireless communication is executed between the antenna for ETC 21*a* that is a first wireless processing means to execute the entrance process through the wireless communication with an on-board unit installed in an entering vehicle and an IC card that is to be inserted into the on-board unit. By this communication, the antenna units 10 and 11 and the controller 19 are provided to execute the entrance process according to the error cases ①~④. The antenna for ETC 31 and the antenna units 35 and 36 are provided in the exit tollhouse. Even when an IC card is not inserted into an on-board unit when a vehicle equipped with an ETC on-board unit enters into an entrance tollhouse of a toll road, the entrance process is completed by the non-contact IC card process by the antenna units 10 and 11 and the controller 19. Provided that an IC card is inserted at the exit tollhouse, the ETC exit process is executed by the antenna for ETC 31. Even when the state with no IC card inserted is continued at the exit tollhouse, the toll collection process can be completed by executing the non-contact IC card process by the antenna units 35 and 36 and the controller 29 and the convenience of ETC users can be promoted.

Further, when an IC card is inserted into or pulled out of an on-board unit after executing the entrance process, the CPU of the IC card reads the on-board unit peculiar information again and reads out the entrance process information (individual card information, entrance processed peculiar information of the on-board unit, vehicle class information discriminated at the entrance, the entrance information, etc.). After this reading process, the entrance process information recorded in a semiconductor memory of an IC card is compared and collated with the entrance process information read from the memory of the on-board unit and the peculiar information of the on-board unit for checking the matching. When the mismatch is confirmed, it is regarded that there is the possibility for illegality and the mismatch and its substance are recorded in the IC card and also, sent to and stored in the memory of the on-board unit into which the IC card is inserted again. Therefore, as the substance of mismatch is sent to and notified to the system side when the toll collection at the exit tollhouse, an illegal deed if any can be detected.

Further, when a vehicle equipped with an on-board unit other than registered for ETC, for example, such a vehicle equipped with an on-board unit not in set with an IC card for ETC as a rental car equipped with an on-board unit uses a toll road, when an IC card is set in the on-board unit, the peculiar information of the on-board unit stored in the on-board unit is read by an operating portion in the IC card and stored in a semiconductor memory. Then, when that vehicle enters into the entrance tollhouse, the peculiar information of the on-board unit stored in an IC card from the on-board unit is obtained by the antenna unit 10 or 11 through the wireless communication with the IC card, identifies the vehicle class and executes the non-contact IC card process. As a result of this non-contact IC card process, the entrance process using the IC card can be executed even when a vehicle class is not input by an official in charge and thus, a processing time can be made short. Further, it becomes possible to use an IC card by a rental car equipped with an on-board unit and therefore, the use of IC cards for two-way interface IC card having the ETC wireless communication function and the non-contract IC card wireless communication function is expanded and users' convenience can be promoted.

Further, when a contact type IC terminal 52 of an IC card used for ETC becomes defective and not usable as a contact type IC, the information in the IC card is read via the antenna for non-contact IC card of the card processor 30 provided in a tollhouse. This read IC card information is sent to the upper rank host 9 requesting an inquiry and when the reply of match is made by the upper rank host 9, the IC card information is replaced in a new card for re-issue. Therefore, it becomes possible to re-issue of IC card at the nearest tollhouse of a toll road and users' convenience can be promoted.

That is, according to the toll collection system of this embodiment, it is possible to introduce a non-contact (wireless type) prepaid IC card system with the improved security in succession to the anonymous, indefinite and disposable magnetic type prepaid card system into a toll road to backup the already introduced ETC system. Thus, it is possible to promote users' convenience while preventing such an illegal deed as the exchange of IC cards in a toll road.

As described above, according to this invention, when an on-board unit equipped on a vehicle entering into a tollhouse of a toll road abnormally finished the process through the wireless communication, the toll collection system obtains information through the wireless communication by an IC card and after executing the comparison and collation of information according an error case when abnormally finished and executes the entrance and exit processes. As a result, the entrance and exit processes are enabled even when an IC card was not inserted into an on-board unit and users' convenience can be promoted.

Further, when IC cards are pulled out from and inserted again into onboard units, peculiar information of both on-board units are compared and collated and therefore, illegal deeds such as exchange of IC cards of vehicles can be detected.

As a result, when an IC card provided with an interface function with an on-board unit and the wireless communication function by a single card is used in a toll road, users' convenience can be promoted while preventing illegal deeds.

What is claimed is:

1. A card processing system using an IC card having an electrical contact and an IC card antenna, the IC card capable of exchanging information through the electrical contact with an on-board unit installed in a vehicle using a toll road, and capable of wireless communication with an antenna unit installed at a roadside of the toll road through the IC card antenna, the card processing system comprising:

a first processor configured to execute at an entrance of the toll road an electronic toll collection process through the wireless communication between the antenna unit installed at the roadside and the on-board unit into which the IC card is inserted to electrically connect the electrical contact of the IC card with the on-board unit;

a second processor configured to execute at the entrance of the toll road a non-contact IC card process through the wireless communication between the antenna unit installed at the roadside and the IC card through the IC card antenna when an error is generated in the electronic toll collection process by the first processor;

comparison/collation means for comparing and collating the peculiar information that are stored in the on-board unit and the IC card, respectively, when the IC card storing entrance information of the toll road is inserted in the on-board unit subsequent to the non-contact IC card process executed by the second processor; and means for storing the entrance information stored in the IC card as a result of the non-contact IC card process executed by the second processor in the on-board unit when peculiar information stored in the on-board unit and the IC card unit are matched to each other by the comparison/collation means.

2. The card processing system according to claim 1, further comprising:

a comparison/collation means for comparing and collating the on-board unit peculiar information and entrance information that should have been stored in the on-board unit and the IC card, respectively when the IC card storing the entrance information obtained by the on-board unit in the entrance processing at the entrance by the first processor is pulled out of the on-board unit and inserted into the on-board unit again; and means for storing a possibility of illegality in at least either one of the IC card and the on-board unit when at least either one of the on-board unit peculiar information and the entrance information is detected as being mismatch.

3. The card processing system according to claim 1, further comprising:

notifying means for notifying that the IC card is not inserted in the on-board unit to a user of the IC card when peculiar information of the on-board unit was obtained by the first processor that is executed at the entrance of the toll road but the individual information of the IC card was not obtained;

comparison/collation means for comparing and collating the peculiar information of the on-board unit stored in the on-board unit and the IC card when the IC card is inserted into the on-board unit; and warning means for warning the possibility of illegality for use of IC cards or on-board units.

4. The card processing system according to claim 1, wherein the second processor is executed through the wireless communication with the IC card pulled out of the on-board unit and further comprising:

detecting means for detecting that the IC card is inserted into the on-board unit; means for storing peculiar information of the on-board unit stored in the onboard unit in the IC card and individual card information stored in the IC card in the on-board unit when the detecting means detects that the IC card is inserted in the onboard unit; and warning means for warning possibility of illegality when the peculiar information of both the on-board units are detected as being mismatched as a result of the collation by the comparison/collation means.

5. The card processing system according to claim 1, further comprising:

detecting means for detecting a contact defect by the communication through the electrical contact provided in the IC card;

reading means for reading out the information stored in the IC card through an antenna provided in the IC card by the second processor when the contact defect is detected by the detecting means;

means for sending the IC card information read by the reading means to an upper rank host computer for enquiry; and means for writing the IC card information in a separate new IC card and reissuing this IC card when the match is answered by the upper rank host computer in response to the enquiry made for the IC card.

6. The card processing system according to claim 1, further comprising a device configured to inform a user of the IC card when the error is generated in the electronic toll collection process by the first processor.

7. The card processing system according to claim 6, wherein the device is a display.

8. A card processing system using an IC card having an electrical contact and an IC card antenna, the IC card capable of exchanging information through the electrical contact with an on-board unit installed in a vehicle using a toll road, and capable of wireless communication with an antenna unit installed at a roadside of the toll road through the IC card antenna, the card processing system comprising:

a first processor configured to execute at an exit of the toll road, an electronic toll collection process through the wireless communication between the antenna unit installed at the roadside and the on-board unit into which the IC card is inserted to electrically connect the electrical contact of the IC card with the on-board unit; and a second processor configured to execute at the exit of the toll road a non-contact IC card process through the wireless communication between the antenna unit installed at the roadside and the IC card through the IC card antenna when an error is generated in the electronic toll collection process by the first processor, and comparison/collation means for comparing and collating the peculiar information of the on-board unit stored in the on-board unit and the IC card, respectively when the IC card is inserted into the on-board unit subsequent to the non-contact IC card process executed by the second processor.

9. The card processing system according to claim 8, wherein the second processor includes judging means for judging the exit process is possible by collating the information obtained from the IC card through the wireless communication with the IC card and the information obtained from the on-board unit before the exit process that is executed by the first processor is abnormally finished, and an exit processor to execute the exit process by determining a vehicle class from the information obtained from the IC card, further comprising:

means for storing information of the result of the exit process by the exit processor and the abnormally finished history information in the exit process by the first processor.

10. The card processing system according to claim 8, further comprising:

notifying means for notifying a user of the IC card that the IC card was not inserted in the on-board unit when peculiar information of the on-board unit was obtained by the first processor that is executed at the exit of the toll road but the peculiar information of the IC card could not be obtained; and warning means for warning a possibility of illegality for use of IC cards or onboard units when the on-board unit peculiar information are detected as being mismatched as a result of the comparison by the comparison/collation means.

11. A card processing method using an IC card having an electrical contact and an IC card antenna, the IC card capable of exchanging information through the electrical contact with an on-board unit installed in a vehicle using a toll road, and capable of wireless communication with an antenna unit installed at a roadside of the toll road through the IC card antenna, the method comprising:

first executing at an entrance of the toll road an electronic toll collection process through the wireless communication between the antenna unit installed at the roadside and the onboard unit into which the IC card is inserted to electrically connect the electrical contact of the IC card with the on-board unit;

second executing at the entrance of the toll road a non-contact IC card process through the wireless communication between the antenna unit installed at the roadside and the IC card through the IC card antenna when an error is generated during the electronic toll collection process in the first executing;

subsequent to the non-contact IC card process executed by the second executing, comparing and collating peculiar information stored in the on-board unit and the IC card, respectively, when the IC card storing entrance information of the toll road is inserted into the on-board unit; and storing the entrance information stored in the IC card as a result of the non-contact IC card process executed by the second executing in the on-board unit when the on-board unit peculiar information are matched to each other in the comparing and collating step.

12. The card processing method according to claim 11, further comprising:

comparing and collating on-board unit peculiar information and entrance information that should be stored in the on-board unit and the IC card, respectively, when the IC card storing the entrance information obtained by the on-board unit in an entrance process of the first executing step performed at the entrance is pulled out of and inserted again into the on-board unit again; and storing a possibility of illegality in at least one of the IC card and the on-board unit when at least either one of the on-board unit peculiar information and the entrance information is mismatched in the comparing and collating step.

13. The card processing method according to claim 11, further comprising:

informing a user of the IC card that the IC card was not inserted into the onboard unit when peculiar information of the on-board unit was obtained but individual information of the IC card could not be obtained in the first executing step performed at the entrance of the toll road;

comparing and collating on-board unit peculiar information stored in the onboard unit and the IC card, respectively when the IC card is inserted into the on-board unit; and warning a possibility of illegality for use of the IC card or on-board unit when the peculiar information of the on-board units are detected as being mismatched as a result of the collation in the comparing and collating step.

14. The card processing method according to claim 11, wherein the second executing step is performed through the wireless communication with the IC card pulled out of the on-board unit, further comprising:

detecting that the IC card is inserted into the on-board unit;

storing on-board unit peculiar information stored in the on-board unit in the IC card and storing individual card information stored in the IC card in the on-board unit;

warning a possibility of illegality when the peculiar information of the onboard units are detected as being mismatched as a result of the collation in the comparing and collating step.

15. The card processing method according to claim 11, further comprising:

detecting a defective contact through the communication with the electric contact provided in the IC card;

reading out information stored in the IC card through an antenna provided in the IC card according to the second executing step when the defect of the contact is detected by the detecting step;

requesting an enquiry by sending the IC card information read in the reading step to an upper rank host computer; and writing the IC card information in a separate new IC card and reissuing this IC card when the match is answered by the upper rank host computer in response to the enquiry made for the IC card in the requesting step.

16. A card processing method using an IC card having an electrical contact and an IC card antenna, the IC card capable of exchanging information through the electrical contact with an on-board unit installed in a vehicle using a toll road, and through a capable wireless communication with an antenna unit installed at a roadside of the toll road through the IC card antenna, the method comprising:

first executing at an exit of the toll road, an electronic toll collection process through the wireless communication between the antenna unit installed at the roadside and the on-board unit into which the IC card is inserted to electrically connect the electrical contact of the IC card with the on-board unit; and second executing at the exit of the toll road a non-contact IC card process through the wireless communication between the antenna unit installed at the roadside and the IC card through the IC card antenna when an error is generated during the electronic toll collection process in the first executing, and subsequent to the non-contact IC card process executed by the second executing, comparing and collating peculiar information of the on-board unit stored in the on-board unit and the IC card, respectively when the IC card is inserted into the on-board unit.

17. The card processing method according to claim 16, wherein the second executing step includes judging whether the exit process can be executable by collating the information obtained from the IC card through the wireless communication with the second executing and the information obtained from the on-board unit before the exit process executed in the first executing step is abnormally finished and the exit processing step to execute the exit process by determining a vehicle class from the information obtained from the IC card when the exit process is judged executable in the judging step, further comprising:

storing the information of the exit processing result in the exit processing step and the history information of the abnormally finished exit process in the first executing step in the IC card.

18. The card processing method according to claim 16, further comprising:

informing a user of the IC card that no card is inserted into the on-board unit when peculiar information of the on-board unit was obtained but individual information of the IC card could not be obtained in the first executing step performed at the exit of the toll road;

comparing and collating the on-board unit peculiar information stored in the on-board unit and the IC card, respectively when the IC card is inserted-into the onboard unit; and warning a possibility of illegality of use of the IC card or on-board unit when peculiar information of the on-board units are detected as being mismatched as a result of the collation in the comparing and collating step.

* * * * *